US009224350B2

(12) United States Patent
Hirakata et al.

(10) Patent No.: US 9,224,350 B2
(45) Date of Patent: Dec. 29, 2015

(54) LIQUID CRYSTAL DISPLAY DEVICE AND DRIVING METHOD OF LIQUID CRYSTAL DISPLAY DEVICE

(75) Inventors: Yoshiharu Hirakata, Kanagawa (JP); Shunpei Yamazaki, Tokyo (JP)

(73) Assignee: Semiconductor Energy Laboratory Co., Ltd. (JP)

( * ) Notice: Subject to any disclaimer, the term of this patent is extended or adjusted under 35 U.S.C. 154(b) by 99 days.

(21) Appl. No.: 13/305,144

(22) Filed: Nov. 28, 2011

(65) Prior Publication Data

US 2012/0133687 A1 May 31, 2012

(30) Foreign Application Priority Data

Nov. 30, 2010 (JP) ..... 2010-266659

(51) Int. Cl.

| | |
|---|---|
| ***G09G 5/00*** | (2006.01) |
| ***G09G 3/36*** | (2006.01) |
| ***G09G 3/00*** | (2006.01) |
| *G09G 3/20* | (2006.01) |

(52) U.S. Cl.

CPC ..... *G09G 3/3648* (2013.01); *G09G 3/003* (2013.01); *G09G 3/2025* (2013.01)

(58) Field of Classification Search

None

See application file for complete search history.

(56) References Cited

U.S. PATENT DOCUMENTS

| | | | | |
|---|---|---|---|---|
| 7,145,536 | B1 | 12/2006 | Yamazaki et al. | |
| 7,646,537 | B2 | 1/2010 | Shestak | |
| 7,889,152 | B2 | 2/2011 | Kim et al. | |
| 8,289,228 | B2 | 10/2012 | Arai | |
| 8,405,709 | B2 | 3/2013 | Hirasawa et al. | |
| 9,142,179 | B2 | 9/2015 | Kimura et al. | |
| 2006/0170834 | A1* | 8/2006 | Kim et al. | 349/15 |
| 2007/0153380 | A1* | 7/2007 | Shestak | 359/463 |
| 2008/0258997 | A1* | 10/2008 | Arai | 345/6 |
| 2009/0303219 | A1* | 12/2009 | Kimura et al. | 345/211 |
| 2010/0165255 | A1 | 7/2010 | Ishitani et al. | |
| 2011/0122239 | A1* | 5/2011 | Baik et al. | 348/58 |
| 2012/0062539 | A1 | 3/2012 | Koyama | |
| 2014/0377893 | A1 | 12/2014 | Ishitani et al. | |

FOREIGN PATENT DOCUMENTS

| | | |
|---|---|---|
| EP | 1 983 764 A2 | 10/2008 |
| EP | 2 136 354 A2 | 12/2009 |
| JP | 2003-259395 | 9/2003 |

(Continued)

OTHER PUBLICATIONS

Kamiya et al., "Carrier transport properties and electronic structures of amorphous oxide semiconductors: the present status", Solid State Physics, Sep. 1, 2009, vol. 44, No. 9, pp. 621-633, Agne Gijutsu Center (English translation).

*Primary Examiner* — Seokyun Moon

(74) *Attorney, Agent, or Firm* — Husch Blackwell LLP

(57) ABSTRACT

In one frame period, a field period in which an image signal is input to pixels in odd-numbered rows and a field period in which an image signal is input to pixels in even-numbered rows are alternately provided. Hues of light transmitted to a pixel portion from a light supply portion are different between two sequential field periods. Further, in a plurality of field periods in one frame period, hues of light transmitted to the pixel portion from the light supply portion are different among a plurality of field periods in which image signals are input to the pixels in the odd-numbered rows, and/or those are different among a plurality of field periods in which image signals are input to the pixels in the even-numbered rows.

16 Claims, 16 Drawing Sheets

(56) References Cited

FOREIGN PATENT DOCUMENTS

| | | | |
|---|---|---|---|
| JP | 2005-292434 | A | 10/2005 |
| JP | 2005-292722 | A | 10/2005 |
| JP | 2006-215554 | A | 8/2006 |
| JP | 2007-183646 | A | 7/2007 |
| JP | 2008-033107 | A | 2/2008 |
| JP | 2008-245068 | A | 10/2008 |
| JP | 2008-268396 | A | 11/2008 |
| JP | 2010-020292 | A | 1/2010 |
| JP | 2010-062695 | A | 3/2010 |
| JP | 2010-170119 | A | 8/2010 |
| WO | WO 2007/078141 | A1 | 7/2007 |

* cited by examiner

LIQUID CRYSTAL DISPLAY DEVICE AND DRIVING METHOD OF LIQUID CRYSTAL DISPLAY DEVICE

BACKGROUND OF THE INVENTION

1. Field of the Invention

An embodiment of the present invention relates to a liquid crystal display device displaying a three-dimensional image and a driving method thereof.

2. Description of the Related Art

The market for display devices displaying three-dimensional images has been growing. Displaying a three-dimensional image can be achieved by artificially creating, with a display device, a difference between retinal images of both eyes (binocular parallax) which may occur when the viewer sees a stereoscopic object with both eyes. Display devices displaying three-dimensional images, which utilize binocular parallax described above, are roughly classified into devices employing a display method utilizing glasses and devices employing a display method without utilizing glasses. In both of the display methods, an image display portion displaying images needs to display both an image for the right eye and an image for the left eye.

In a liquid crystal display device displaying a three-dimensional image, power consumption of a light supply portion such as a backlight or a frontlight largely affects power consumption of the liquid crystal display device as a whole, as in a liquid crystal display device displaying a two-dimensional image. Therefore, a reduction of light loss within a panel is important for a reduction of power consumption. To avoid a problem of light loss due to a color filter, field-sequential driving (FS driving) is effective. The FS driving is a driving method for displaying a full-color image by sequentially turning on a plurality of light sources whose hues are different from each other. It is not necessary to use a color filter in the FS driving, which leads to a reduction in light loss within a panel; thus, the transmittance of the panel can be improved. Accordingly, the use efficiency of light from a light supply portion can be improved and power consumption of a liquid crystal display device as a whole can be reduced. Further, in the FS driving, images corresponding to different colors are displayed per pixel; thus, a high-definition image can be displayed.

Patent Document 1 below discloses an FS liquid crystal display device which can display a three-dimensional image.

REFERENCE

Patent Document

[Patent Document 1] Japanese Published Patent Application No. 2003-259395

SUMMARY OF THE INVENTION

However, in FS driving, a phenomenon called a color break in which images for different colors are perceived separately without being synthesized easily occurs. In particular, a color break tends to occur remarkably in displaying a moving image.

In particular, the frame frequency is likely to be lower in the case where an image for the left eye and an image for the right eye are alternately displayed on a screen and are seen through glasses with shutters so that viewer's eyes can perceive a three-dimensional image than that in the case where a two-dimensional image is displayed. Therefore, color breaks are easily perceived.

In a liquid crystal display device displaying a three-dimensional image, the frame frequency is likely to be lower than that in a liquid crystal display device displaying a two-dimensional image; therefore, a phenomenon called a flicker in which the viewer perceives flickering on a screen easily occurs.

In view of the above problems, an object of the present invention is to provide a driving method of a liquid crystal display device whose power consumption can be low and which prevents generation of color breaks and can display a full-color three-dimensional image. Another object of the present invention is to provide a driving method of a liquid crystal display device whose power consumption can be low and which prevents generation of flickers and can display a full-color image. Another object of the present invention is to provide a liquid crystal display device whose power consumption can be low and which prevents generation of color breaks or flickers and can display a full-color three-dimensional image.

In order to achieve the above objects, in a driving method according to one embodiment of the present invention, an image signal is input to pixels in odd-numbered rows in a pixel portion in a given field period among a plurality of field periods in one frame period. In a field period following the above field period, an image signal is input to pixels in even-numbered rows in the pixel portion. That is, in a driving method according to one embodiment of the present invention, a field period in which an image signal is input to pixels in odd-numbered rows and a field period in which an image signal is input to pixels in even-numbered rows are alternately provided.

In one embodiment of the present invention, hues of light transmitted to a pixel portion from a light supply portion are different between two sequential field periods. Further, in a plurality of field periods in one frame period, hues of light transmitted to the pixel portion from the light supply portion are different among a plurality of field periods in which image signals are input to the pixels in the odd-numbered rows, and/or hues of light transmitted to the pixel portion from the light supply portion are different among a plurality of field periods in which image signals are input to the pixels in the even-numbered rows.

In a driving method according to one embodiment of the present invention, an image for the right eye is displayed in a given field period among a plurality of field periods, and an image for the left eye is displayed in a field period following the above field period. In this manner, a three-dimensional image is displayed.

In one embodiment of the present invention, with the above structure, in given two sequential field periods among a plurality of field periods in one frame period, an image displayed in the pixels in the odd-numbered rows and an image displayed in the pixels in the even-numbered rows correspond to different hues. In addition, hues of images displayed in the pixels in the odd-numbered rows are different among field periods in one frame period, and/or hues of images displayed in the pixels in the even-numbered rows are different among field periods in one frame period. Consequently, images corresponding to different hues can be prevented from being perceived separately without being synthesized, and generation of color breaks, which has tended to occur in displaying a moving image, can be prevented. Therefore, by employing a driving method according to one embodiment of the present invention, in a liquid crystal display device, power consumption can be low, generation of color breaks can be prevented, and a full-color two-dimensional or three-dimensional image can be displayed.

In one embodiment of the present invention, an image is displayed by synthesizing an image displayed in the pixels in the odd-numbered rows and an image displayed in the pixels in the even-numbered rows, so that generation of flickers can be suppressed. Therefore, by employing a driving method according to one embodiment of the present invention, power consumption can be low, generation of flickers can be prevented, and a full-color image can be displayed. Since generation of flickers is prevented, eye fatigue of the viewer can be suppressed.

DETAILED DESCRIPTION OF THE INVENTION

Hereinafter, embodiments of the present invention will be described in detail with reference to the accompanying drawings. Note that the present invention is not limited to the following description and it is easily understood by those skilled in the art that the mode and details can be variously changed without departing from the spirit and scope of the present invention. Therefore, the present invention should not be construed as being limited to the description in the following embodiments.

Embodiment 1

Figure 1:
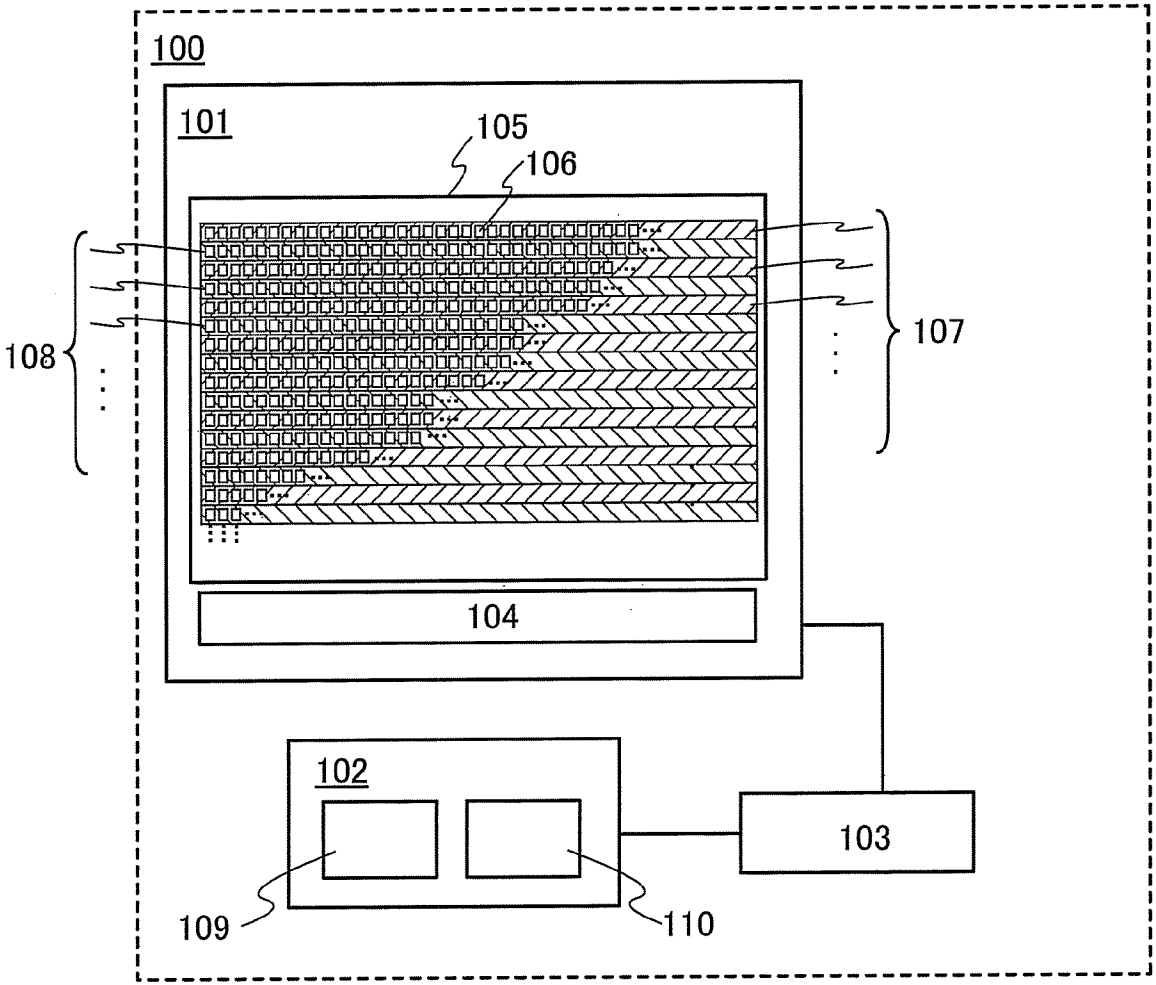
FIG. 1 is a block diagram of a liquid crystal display device.

FIG. 1 is a block diagram illustrating a structural example of a liquid crystal display device used in a driving method according to one embodiment of the present invention. A liquid crystal display device 100 includes an image display portion 101 for displaying an image; a light-blocking portion 102 for selecting an image for the right eye or an image for the left eye; a control portion 103 which synchronizes display of an image on the image display portion 101 with selection of an image for the right eye or an image for the left eye in the light-blocking portion 102; and a light supply portion 104.

The image display portion 101 has a plurality of pixels 106 in a pixel portion 105. Each of the pixels 106 includes a liquid crystal element and the liquid crystal element displays a gray scale in response to an image signal, whereby images can be displayed on the pixel portion 105.

Some of the plurality of pixels 106 included in the pixel portion 105 are positioned in a first display region 107, and the others are positioned in a second display region 108. Specifically, the first display region 107 includes the pixels 106 in odd-numbered rows, and the second display region 108 includes the pixels 106 in even-numbered rows. Therefore, the first display region 107 and the second display region 108 are alternately arranged in the pixel portion 105.

In one embodiment of the present invention, after an image signal is input to the pixels 106 in the first display region 107 in a given field period, an image signal is input to the pixels 106 in the second display region 108 in a field period following that. With the above structure, an image signal can be written to all the pixels 106 in the pixel portion 105 at least once through a plurality of field periods.

Though a plurality of field periods, an image corresponding to the pixels in the odd-numbered rows and an image corresponding to the pixels in the even-numbered rows are alternately displayed in the first display region 107 and the second display region 108, respectively, whereby a two-dimensional image can be displayed. Through a plurality of field periods, an image for the right eye and an image for the left eye are alternately displayed in the first display region 107 and the second display region 108, whereby a three-dimensional image can be displayed.

The light supply portion 104 includes a plurality of light sources whose hues are different from each other. The plurality of light sources emit light sequentially or concurrently, whereby light corresponding to different hues can be sequentially transmitted to the pixel portion 105. As the light sources of the light supply portion 104, a cold cathode fluorescent lamp, a light-emitting diode (LED), an OLED element which generates luminescence (electroluminescence) by application of an electric field, or the like can be used.

In FIG. 1, the light-blocking portion 102 includes a light control portion 109 for the left eye which can make light that corresponds to an image for the left eye and is transmitted from the pixel portion 105 enter the left eye selectively, and a light control portion 110 for the right eye which can make light that corresponds to an image for the right eye and is transmitted from the pixel portion 105 enter the right eye selectively. As the light control portion 109 for the left eye and the light control portion 110 for the right eye, a shutter of a liquid crystal panel or the like can be used. With the use of such a shutter, the amount of light entering eyes of the viewer can be controlled by changing transmittance with the supply of current or voltage. In this case, the light control portion 109 for the left eye and the light control portion 110 for the right eye may each have a liquid crystal panel. Alternatively, one liquid crystal panel may be shared by them. In the latter case, in the above liquid crystal panel, the transmittance of a region used as the light control portion 109 for the left eye and that of a region used as the light control portion 110 for the right eye may be separately controlled.

In a period during which one of the first display region 107 and the second display region 108 in the pixel portion 105 displays an image for the left eye, the control portion 103 synchronizes operation of the image display portion 101 with operation of the light-blocking portion 102 so as to raise the transmittance of the light control portion 109 for the left eye and lower the transmittance of the light control portion 110 for the right eye, ideally to 0%. In a period during which one of the first display region 107 and the second display region 108 in the pixel portion 105 displays an image for the right eye, the control portion 103 synchronizes operation of the image display portion 101 with operation of the light-blocking portion 102 so as to lower the transmittance of the light control portion 109 for the left eye, ideally to 0%, and raise the transmittance of the light control portion 110 for the right eye. Further, in a writing period during which an image signal of an image for the left eye or the right eye is written to the first display region 107 or the second display region 108 in the pixel portion 105, the control portion 103 synchronizes operation of the image display portion 101 with operation of the light-blocking portion 102 so as to lower the transmittance of the light control portion 109 for the left eye and the transmittance of the light control portion 110 for the right eye, ideally to 0%.

With the control portion 103, as described above, the operation of the image display portion 101 and the operation of the light-blocking portion 102 are synchronized with each other, so that operation in which an image for the left eye is seen with the left eye of the viewer and operation in which an image for the right eye is seen with the right eye of the viewer can be alternately performed. The above structure allows the viewer to see a three-dimensional image formed using an image for the left eye and an image for the right eye.

Note that as the light control portion 109 for the left eye and the light control portion 110 for the right eye, a polarizing plate that can select light entering eyes of the viewer with a polarization direction may be used instead of the shutter. In this case, the image display portion 101 and the light-blocking portion 102 do not need to operate in synchronization with each other, so that the control portion 103 is not necessarily provided. In the case where a polarizing plate is used as the light control portion 109 for the left eye and the light control portion 110 for the right eye, a means for changing a polarization direction is provided between the pixel portion 105 and the light-blocking portion 102 so as to differentiate the polarization direction of light emitted from the first display region 107 from the polarization direction of light emitted from the second display region 108. With the above structure, light from the first display region 107 passes through one of the light control portion 109 for the left eye and the light control portion 110 for the right eye selectively, and light from the second display region 108 passes through the other of the light control portion 109 for the left eye and the light control portion 110 for the right eye selectively.

Figure 2:
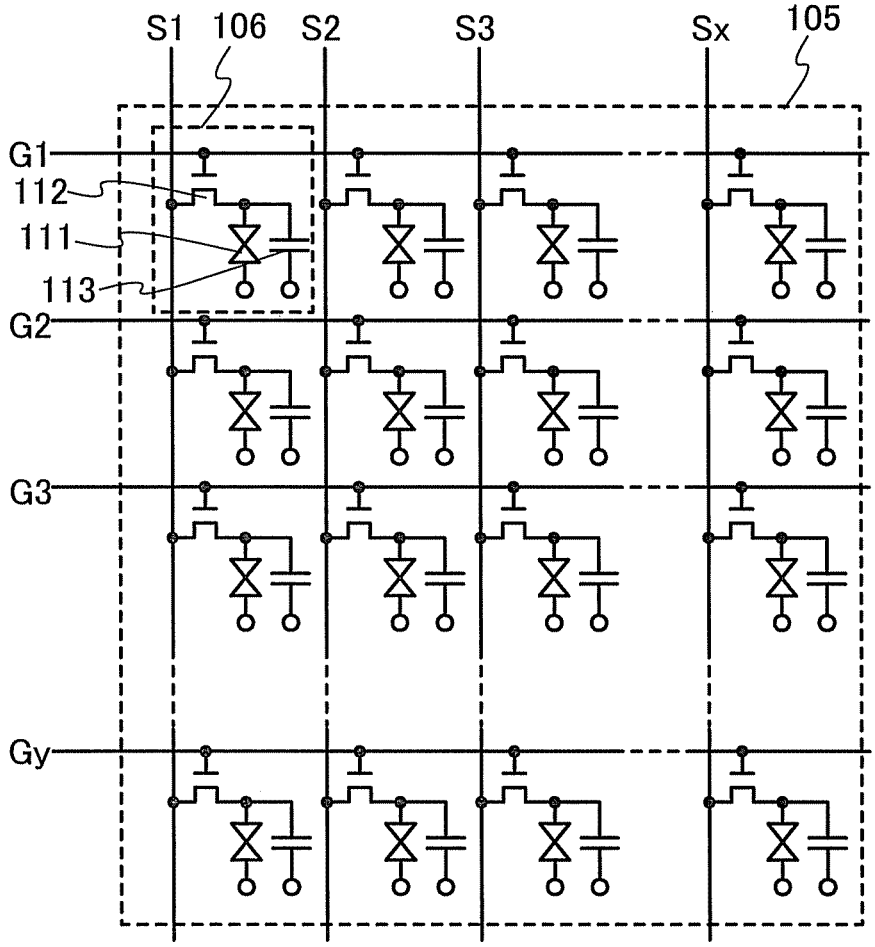
FIG. 2 is a circuit diagram of a pixel portion.

An example of a specific structure of the pixel portion 105 in the liquid crystal display device according to one embodiment of the present invention is illustrated in FIG. 2.

In FIG. 2, each of the pixels 106 in the pixel portion 105 includes a liquid crystal element 111, a transistor 112 for controlling supply of an image signal to the liquid crystal element 111, and a capacitor 113 for holding a voltage between a pixel electrode and a common electrode of the liquid crystal element 111. The liquid crystal element 111 includes the pixel electrode, the common electrode, and a liquid crystal layer having liquid crystal to which a voltage between the pixel electrode and the common electrode is applied.

The liquid crystal layer can be formed using, e.g., a liquid crystal material classified into thermotropic liquid crystal and lyotropic liquid crystal. Alternatively, the liquid crystal layer can be formed using, e.g., a liquid crystal material classified into nematic liquid crystal, smectic liquid crystal, cholesteric liquid crystal, and discotic liquid crystal. Further alternatively, the liquid crystal layer can be formed using, e.g., a liquid crystal material classified into ferroelectric liquid crystal and anti-ferroelectric liquid crystal. Further alternatively, the liquid crystal layer can be formed using, e.g., a liquid crystal material classified into high-molecular liquid crystal such as main-chain high-molecular liquid crystal, side-chain high-molecular liquid crystal, or composite-type high-molecular liquid crystal, and low-molecular liquid crystal. Further alternatively, the liquid crystal layer can be formed using, e.g., a liquid crystal material classified as polymer dispersed liquid crystal (PDLC).

Alternatively, liquid crystal exhibiting a blue phase for which an alignment film is unnecessary may be used for the liquid crystal layer. A blue phase is one of liquid crystal phases, which is generated just before a cholesteric phase changes into an isotropic phase while temperature of cholesteric liquid crystal is increased. Since the blue phase is only generated within a narrow range of temperature, a chiral agent or an ultraviolet curable resin is added so that the temperature range is improved. The liquid crystal composition which includes liquid crystal exhibiting a blue phase and a chiral agent is preferable because it has a small response time of 1 msec or less, has optical isotropy, which makes the alignment process unneeded, and has a small viewing angle dependence.

Moreover, the following methods can be used for driving the liquid crystal, for example: a TN (twisted nematic) mode, an STN (super twisted nematic) mode, a VA (vertical alignment) mode, an IPS (in-plane-switching) mode, an OCB (optically compensated birefringence) mode, an FFS (fringe field switching) mode, a blue phase mode, a TBA (transverse bend alignment) mode, a VA-IPS mode, an ECB (electrically controlled birefringence) mode, an FLC (ferroelectric liquid crystal) mode, an AFLC (anti-ferroelectric liquid crystal) mode, a PDLC (polymer dispersed liquid crystal) mode, and a PNLC (polymer network liquid crystal) mode.

A plurality of scan lines for selecting the plurality of pixels 106 and a plurality of signal lines for supplying image signals to the selected pixels 106 are connected to the plurality of pixels 106. Specifically, each of the pixels 106 is connected to at least one of signal lines S1 to Sx and at least one of scan lines G1 to Gy.

The transistor 112 controls whether a potential of the signal line is applied to the pixel electrode of the liquid crystal element 111. A predetermined reference potential is applied to the common electrode of the liquid crystal element 111.

The terms "source terminal" and "drain terminal" included in a transistor interchange with each other depending on the polarity of the transistor or difference between the potentials applied to the respective electrodes. In general, in an n-channel transistor, an electrode to which a lower potential is applied is called a source terminal, and an electrode to which a higher potential is applied is called a drain terminal. Further, in a p-channel transistor, an electrode to which a lower potential is applied is called a drain terminal, and an electrode to which a higher potential is applied is called a source terminal. A specific connection relation of the transistor 112 and the liquid crystal element 111 will be described below on the assumption that one of a source electrode and a drain electrode is a first terminal and the other is a second terminal.

In addition, the "source terminal" of the transistor means a source region which is part of an active layer or a source electrode which is connected to an active layer. Similarly, the "drain terminal" of the transistor means a drain region which is part of an active layer or a drain electrode which is connected to an active layer.

A gate electrode of the transistor 112 is connected to any one of the scan lines G1 to Gy. A first terminal of the transistor 112 is connected to any one of the signal lines S1 to Sx, and a second terminal of the transistor 112 is connected to the pixel electrode of the liquid crystal element 111.

In the case of the pixel portion 105 in FIG. 2, the pixels 106 connected to one of the scan lines G1 to Gy corresponds to the pixels 106 in one row. Therefore, the pixels 106 connected to the scan lines G1, G3, G5, and the like in odd-numbered rows are included in the first display region 107 in FIG. 1. In addition, the pixels 106 connected to the scan lines G2, G4, G6, and the like in even-numbered rows are included in the second display region 108 in FIG. 1.

Note that the pixel 106 may further have another circuit element such as a transistor, a diode, a resistor, a capacitor, or an inductor as needed.

Note that FIG. 2 illustrates a case where one transistor 112 is used as a switching element in the pixel 106; however, one embodiment of the present invention is not limited to this structure. A plurality of transistors may be used as one switching element. In the case where a plurality of transistors function as one switching element, the plurality of transistors may be connected to each other in parallel, in series, or in combination of parallel connection and series connection.

In this specification, the state in which the transistors are connected to each other in series, for example, means a state in which only one of a first terminal and a second terminal of a first transistor is connected to only one of a first terminal and a second terminal of a second transistor. Further, the state in which the transistors are connected to each other in parallel means a state in which the first terminal of the first transistor is connected to the first terminal of the second transistor and the second terminal of the first transistor is connected to the second terminal of the second transistor.

Note that the term "connection" in this specification refers to electrical connection and corresponds to the state in which current, voltage, or a potential can be supplied or transmitted. Accordingly, a connection state means not only a state of a direct connection but also a state of indirect connection through a circuit element such as a wiring, a resistor, a diode, or a transistor so that current, voltage, or a potential can be supplied or transmitted.

Even when a circuit diagram illustrates independent components which are connected to each other, there is a case where one conductive film has functions of a plurality of components such as the case where part of a wiring functions as an electrode. In this specification, the term "connection" also means such a case where one conductive film has functions of a plurality of components.

Next, an example of operation of the pixel portion 105 in FIG. 2 in the case where a three-dimensional image is displayed will be described.

First, the scan line G1 is selected by inputting a signal with a pulse to the scan line G1. In each of the plurality of pixels 106 connected to the selected scan line G1, the transistor 112 is turned on. When a potential of an image signal is supplied to the signal lines S1 to Sx in the state where the transistor 112 is on, charge is accumulated in the capacitor 113 and the potential of the image signal is applied to the pixel electrode of the liquid crystal element 111 through the on-state transistor 112.

In the liquid crystal element 111, the orientation of liquid crystal molecules is changed according to the level of the voltage applied between the pixel electrode and the common electrode, whereby transmittance is changed. Accordingly, the transmittance of the liquid crystal element 111 can be controlled by the potential of the image signal; thus, a gray scale can be displayed.

When input of image signals to the signal lines S1 to Sx is completed, the selection of the scan line G1 is terminated. When the selection of the scan line G1 is terminated, the transistors 112 are turned off in the pixels 106 connected to the scan line G1. Then, voltage applied between the pixel electrode and the common electrode is held in the liquid crystal element 111, whereby display of a gray scale is maintained.

Next, the scan line G2 is selected by inputting a signal with a pulse to the scan line G2. In each of the plurality of pixels 106 connected to the selected scan line G2, the transistor 112 is turned on. When a potential of a blanking signal with no image data is applied to the signal lines S1 to Sx in the state where the transistor 112 is on, the potential of the blanking signal is applied to the pixel electrode of the liquid crystal element 111 through the on-state transistor 112. The transmittance of the liquid crystal element 111 is controlled by the potential of the blanking signal; thus, a single gray scale is displayed.

When input of blanking signals to the signal lines S1 to Sx is completed, the selection of the scan line G2 is terminated. When the selection of the scan line G2 is terminated, the transistors 112 are turned off in the pixels 106 connected to the scan line G2. Then, voltage applied between the pixel electrode and the common electrode is held in the liquid crystal element 111, whereby display of a gray scale is maintained. Next, the scan line G3 is selected, and operation similar to that in the period during which the scan line G1 is selected is performed in the pixels connected to the scan line G3. Then, the scan line G4 is selected, and operation similar to that in the period during which the scan line G2 is selected is performed in the pixels connected to the scan line G4.

The above operations are repeatedly performed, whereby an image can be displayed in the first display region 107 in FIG. 1 and a single gray scale with no image data can be displayed in the second display region 108. Then, when a period during which all the pixels in the first display region 107 and the second display region 108 included in the pixel portion 105 complete displaying images is referred to as a first field period, a single gray scale with no image data is displayed in the first display region 107 and an image is displayed in the second display region 108 in a second field period following that.

An image for the right eye is displayed in the first display region 107 in the first field period and an image for the left eye is displayed in the second display region 108 in the second field period, whereby a three-dimensional image can be displayed.

According to one embodiment of the present invention, in given two sequential field periods, an image displayed in the first display region 107 and an image displayed in the second display region 108 correspond to different hues. In addition, in one frame period, the hue of an image displayed in the first display region 107 is changed according to the field period, and/or the hue of an image displayed in the second display region 108 is changed according to the field period. With the above structure, according to one embodiment of the present invention, a full-color image can be displayed.

FIGS. 3A to 3F schematically illustrate an example of operation of the pixel portion 105 in the case where a monochrome image is alternately displayed in the first display region 107 and the second display region 108 through six field periods so that a full-color three-dimensional image is displayed.

Note that a full-color image refers to an image displayed with color gradations of a plurality of colors having different hues. In addition, a monochrome image refers to an image displayed with a gradation of a color having a single hue.

Figure 3A:
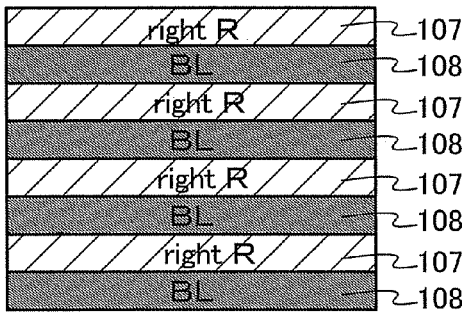
FIGS. 3A to 3F schematically illustrate an example of operation of a pixel portion.

FIG. 3A illustrates operation of the pixel portion 105 in a first field period. An image for the right eye, which corresponds to red (right R), is displayed in the first display region 107. A single gray scale (BL) is displayed in the second display region 108.

Figure 4A:
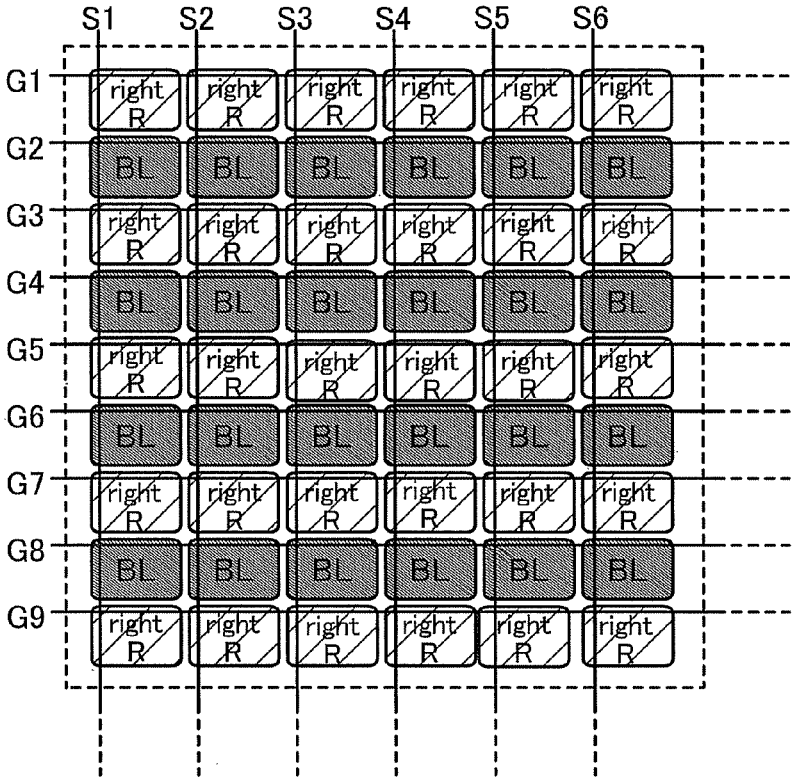
FIGS. 4A and 4B each schematically illustrate part of arranged pixels.

FIG. 4A schematically illustrates an example of part of pixels which are arranged so as to be included in the first display region 107 and the second display region 108 in FIG. 3A. In FIG. 4A, an image for the right eye, which corresponds to red (right R), is displayed in the pixels connected to the scan lines G1, G3, G5, G7, and G9 and included in the first display region 107. Further, in FIG. 4A, a single gray scale (BL) is displayed in the pixels connected to the scan lines G2, G4, G6, and G8 and included in the second display region 108.

Figure 3B:
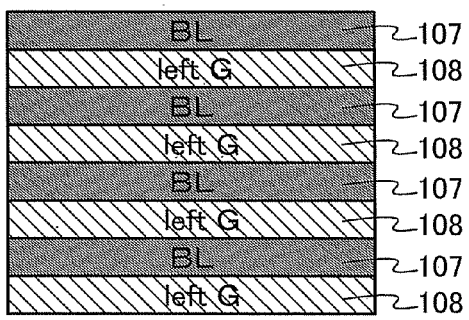

FIG. 3B illustrates operation of the pixel portion 105 in a second field period. A single gray scale (BL) is displayed in the first display region 107. An image for the left eye, which corresponds to green (left G), is displayed in the second display region 108.

Figure 4B:
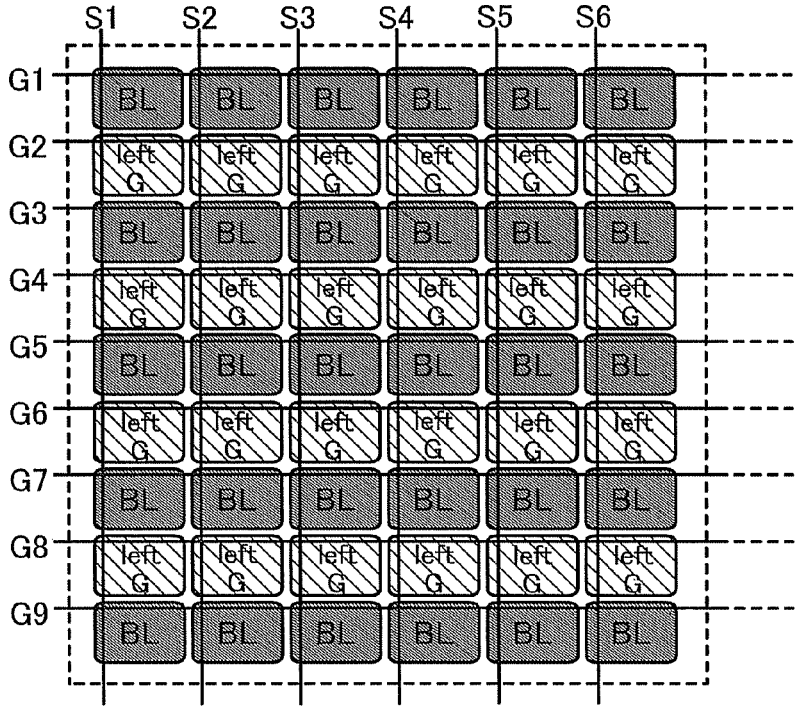

FIG. 4B schematically illustrates an example of part of pixels which are arranged so as to be included in the first display region 107 and the second display region 108 in FIG. 3B. In FIG. 4B, a single gray scale (BL) is displayed in the pixels connected to the scan lines G1, G3, G5, G7, and G9 and included in the first display region 107. Further, in FIG. 4B, an image for the left eye, which corresponds to green (left G), is displayed in the pixels connected to the scan lines G2, G4, G6, and G8 and included in the second display region 108.

Figure 3C:
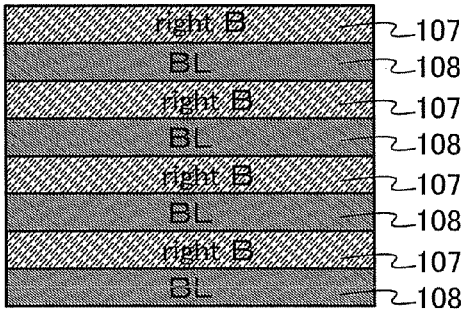

FIG. 3C illustrates operation of the pixel portion 105 in a third field period. An image for the right eye, which corresponds to blue (right B), is displayed in the first display region 107. A single gray scale (BL) is displayed in the second display region 108.

Figure 5A:
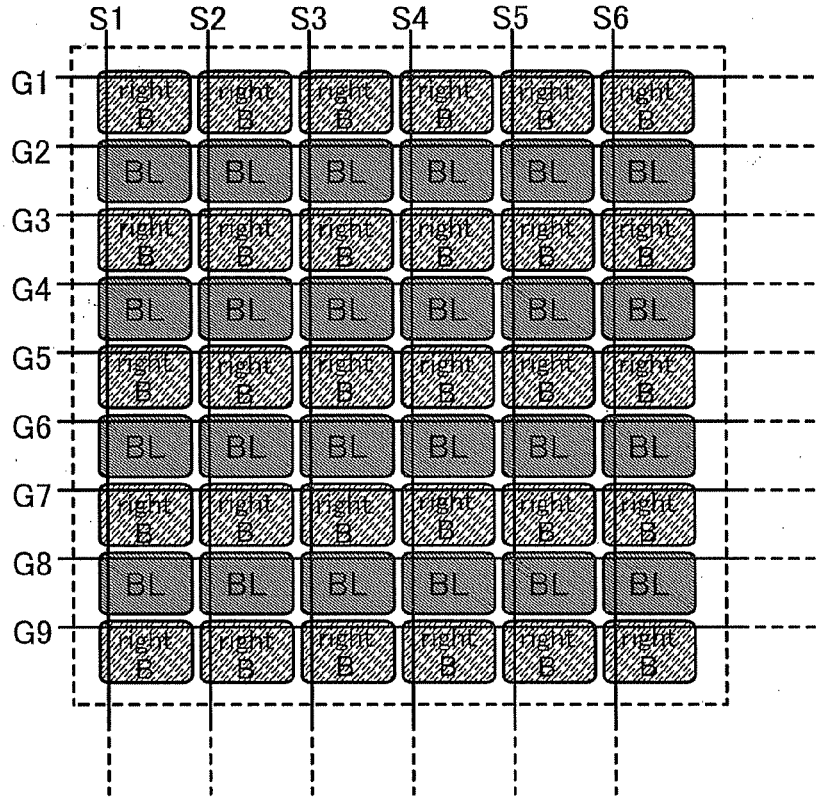
FIGS. 5A and 5B each schematically illustrate part of arranged pixels.

FIG. 5A schematically illustrates an example of part of pixels which are arranged so as to be included in the first display region 107 and the second display region 108 in FIG. 3C. In FIG. 5A, an image for the right eye, which corresponds to blue (right B), is displayed in the pixels connected to the scan lines G1, G3, G5, G7, and G9 and included in the first display region 107. Further, in FIG. 5A, a single gray scale (BL) is displayed in the pixels connected to the scan lines G2, G4, G6, and G8 and included in the second display region 108.

Figure 3D:
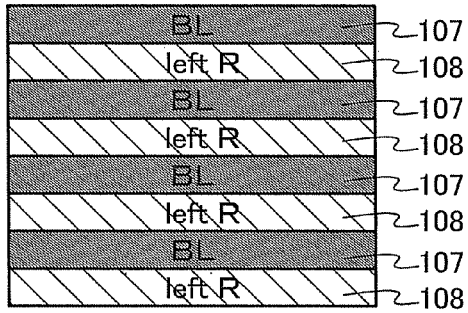

FIG. 3D illustrates operation of the pixel portion 105 in a fourth field period. A single gray scale (BL) is displayed in the first display region 107. An image for the left eye, which corresponds to red (left R), is displayed in the second display region 108.

Figure 5B:
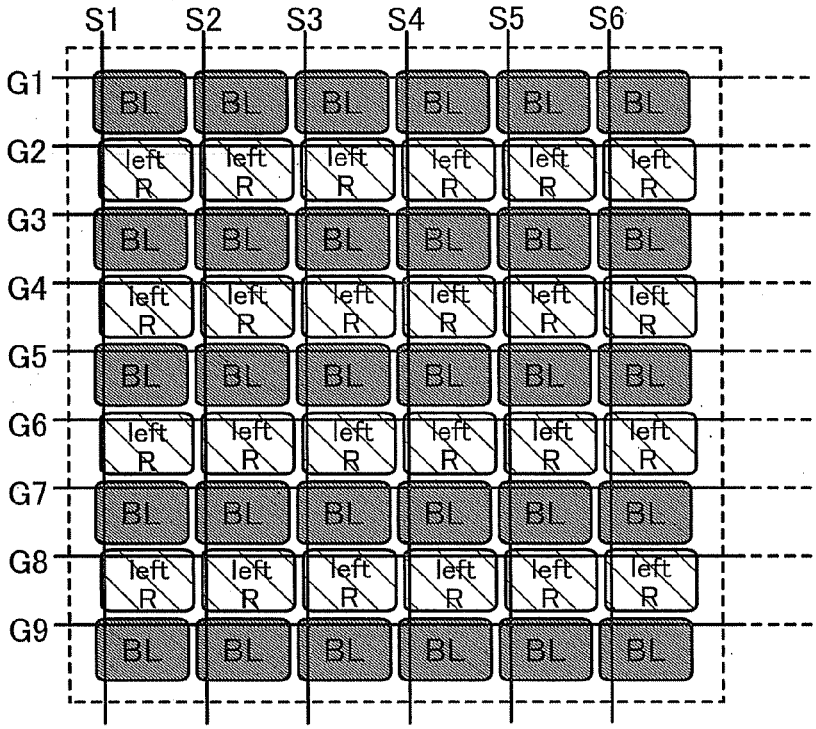

FIG. 5B schematically illustrates an example of part of pixels which are arranged so as to be included in the first display region 107 and the second display region 108 in FIG. 3D. In FIG. 5B, a single gray scale (BL) is displayed in the pixels connected to the scan lines G1, G3, G5, G7, and G9 and included in the first display region 107. Further, in FIG. 5B, an image for the left eye, which corresponds to red (left R), is displayed in the pixels connected to the scan lines G2, G4, G6, and G8 and included in the second display region 108.

Figure 3E:
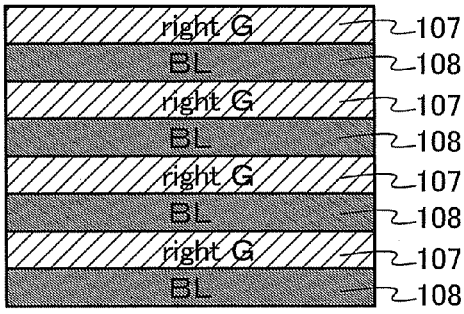

FIG. 3E illustrates operation of the pixel portion 105 in a fifth field period. An image for the right eye, which corresponds to green (right G), is displayed in the first display region 107. A single gray scale (BL) is displayed in the second display region 108.

Figure 6A:
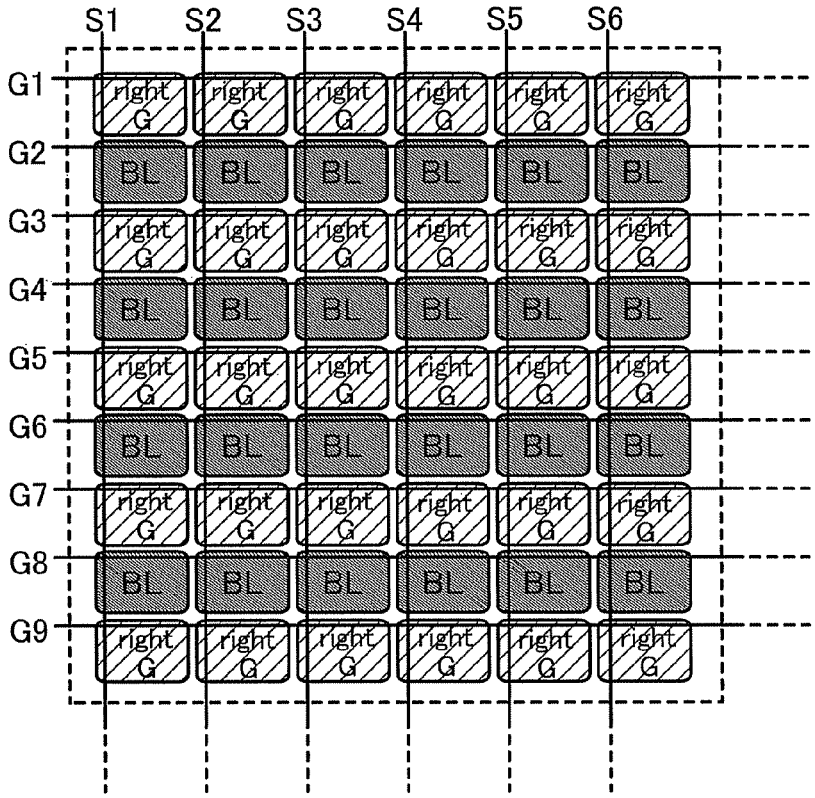
FIGS. 6A and 6B each schematically illustrate part of arranged pixels.

FIG. 6A schematically illustrates an example of part of pixels which are arranged so as to be included in the first display region 107 and the second display region 108 in FIG. 3E. In FIG. 6A, an image for the right eye, which corresponds to green (right G), is displayed in the pixels connected to the scan lines G1, G3, G5, G7, and G9 and included in the first display region 107. Further, in FIG. 6A, a single gray scale (BL) is displayed in the pixels connected to the scan lines G2, G4, G6, and G8 and included in the second display region 108.

Figure 3F:
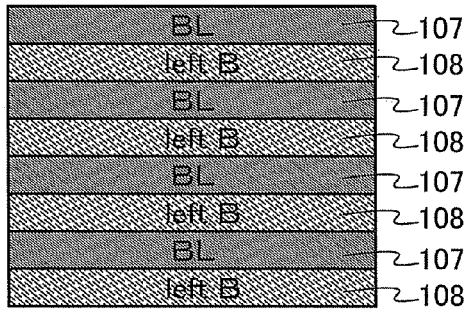

FIG. 3F illustrates operation of the pixel portion 105 in a sixth field period. A single gray scale (BL) is displayed in the first display region 107. An image for the left eye, which corresponds to blue (left B), is displayed in the second display region 108.

Figure 6B:
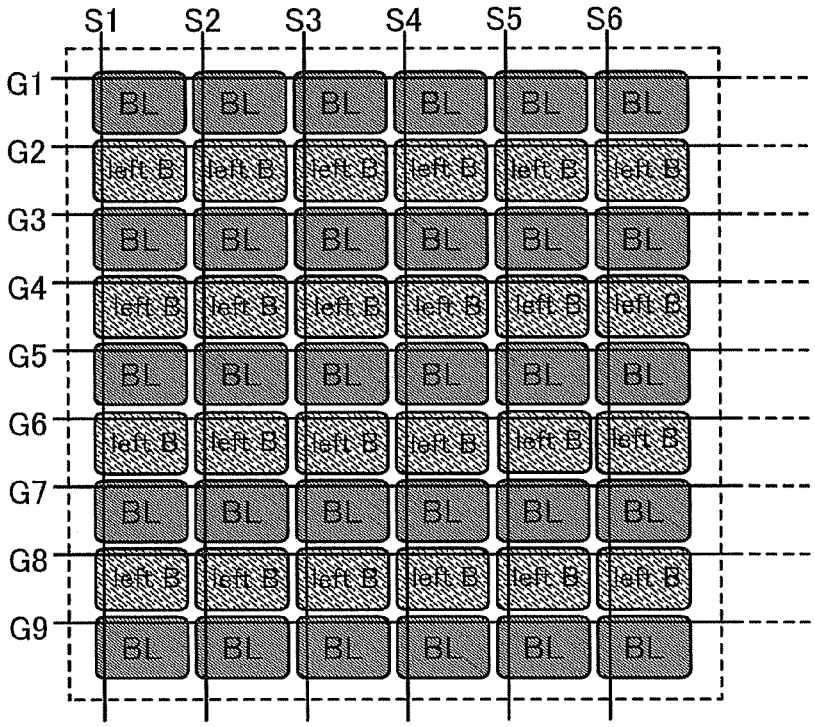

FIG. 6B schematically illustrates an example of part of pixels which are arranged so as to be included in the first display region 107 and the second display region 108 in FIG. 3F. In FIG. 6B, a single gray scale (BL) is displayed in the pixels connected to the scan lines G1, G3, G5, G7, and G9 and included in the first display region 107. Further, in FIG. 6B, an image for the left eye, which corresponds to blue (left B), is displayed in the pixels connected to the scan lines G2, G4, G6, and G8 and included in the second display region 108.

Images are displayed from the first field period through the sixth field period in the above manner, whereby a full-color three-dimensional image can be displayed.

As described above, according to one embodiment of the present invention, in given two sequential field periods, an image displayed in the first display region 107 and an image displayed in the second display region 108 correspond to different hues. In addition, in one frame period, the hue of an image displayed in the first display region 107 is changed according to the field period, and/or the hue of an image displayed in the second display region 108 is changed according to the field period. In one embodiment of the present invention, with the above structure, images corresponding to different hues can be prevented from being perceived separately without being synthesized, and generation of color breaks, which has tended to occur in displaying a moving image, can be prevented. Therefore, by employing a driving method according to one embodiment of the present invention, in a liquid crystal display device, power consumption can be low, generation of color breaks can be prevented, and a full-color three-dimensional image can be displayed. Further, in one embodiment of the present invention, a three-dimensional image is displayed by synthesizing an image for the right eye displayed in the pixels in the odd-numbered rows and an image for the left eye displayed in the pixels in the even-numbered rows, so that generation of flickers can be suppressed.

Note that FIGS. 3A to 3F illustrate an example of a case where a full-color three-dimensional image is displayed. In addition, with the use of a driving method according to one embodiment of the present invention, a two-dimensional image can also be displayed.

FIGS. 7A to 7F schematically illustrate an example of operation of the pixel portion 105 in the case where a monochrome image is alternately displayed in the first display region 107 and the second display region 108 through six field periods so that a full-color two-dimensional image is displayed. In the case where a two-dimensional image is displayed, an image corresponding to the pixels in the odd-numbered rows and an image corresponding to the pixels in the even-numbered rows are alternately displayed in the first display region 107 and the second display region 108, respectively.

Figure 7A:
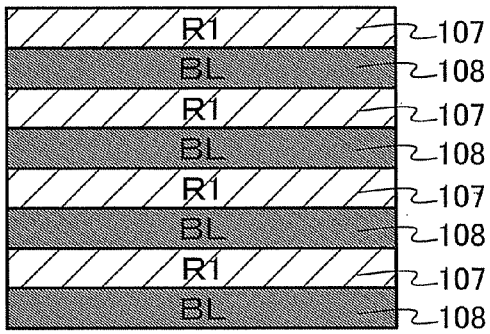
FIGS. 7A to 7F schematically illustrate an example of operation of a pixel portion.

FIG. 7A illustrates operation of the pixel portion 105 in a first field period. An image for the odd-numbered rows, which corresponds to red (R1), is displayed in the first display region 107. A single gray scale (BL) is displayed in the second display region 108.

Figure 7B:
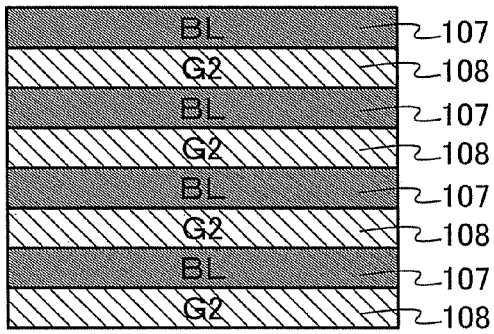

FIG. 7B illustrates operation of the pixel portion 105 in a second field period. A single gray scale (BL) is displayed in the first display region 107. An image for the even-numbered rows, which corresponds to green (G2), is displayed in the second display region 108.

Figure 7C:
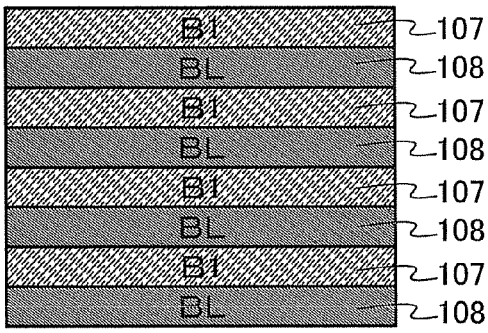

FIG. 7C illustrates operation of the pixel portion 105 in a third field period. An image for the odd-numbered rows, which corresponds to blue (B1), is displayed in the first display region 107. A single gray scale (BL) is displayed in the second display region 108.

Figure 7D:
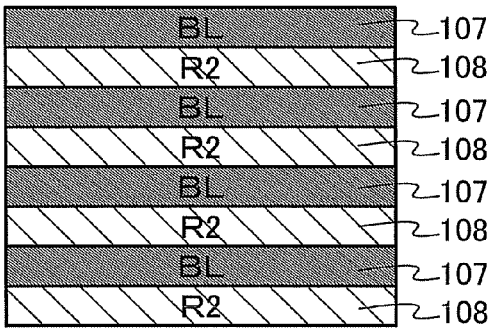

FIG. 7D illustrates operation of the pixel portion 105 in a fourth field period. A single gray scale (BL) is displayed in the first display region 107. An image for the even-numbered rows, which corresponds to red (R2), is displayed in the second display region 108.

Figure 7E:
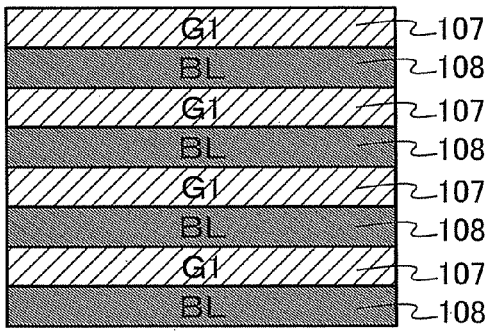

FIG. 7E illustrates operation of the pixel portion 105 in a fifth field period. An image for the odd-numbered rows, which corresponds to green (G1), is displayed in the first display region 107. A single gray scale (BL) is displayed in the second display region 108.

Figure 7F:
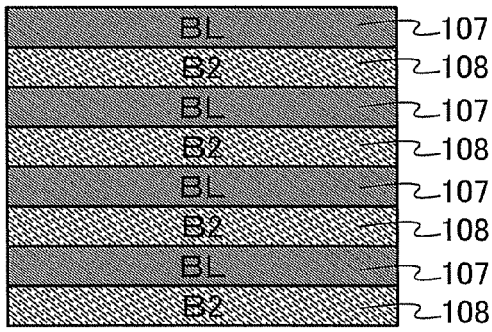

FIG. 7F illustrates operation of the pixel portion 105 in a sixth field period. A single gray scale (BL) is displayed in the first display region 107. An image for the even-numbered rows, which corresponds to blue (B2), is displayed in the second display region 108.

Images are displayed from the first field period through the sixth field period in the above manner, whereby a full-color two-dimensional image can be displayed.

Also when a two-dimensional image is displayed, according to one embodiment of the present invention, in given two sequential field periods, an image for the odd-numbered rows which is displayed in the first display region 107 and an image for the even-numbered rows which is displayed in the second display region 108 correspond to different hues. In addition, in one frame period, the hue of an image for the odd-numbered rows which is displayed in the first display region 107 is changed according to the field period, and/or the hue of an image for the even-numbered rows which is displayed in the second display region 108 is changed according to the field period. In one embodiment of the present invention, with the above structure, images corresponding to different hues can be prevented from being perceived separately without being synthesized, and generation of color breaks, which has tended to occur in displaying a moving image, can be prevented. Therefore, by employing a driving method according to one embodiment of the present invention, in a liquid crystal display device, power consumption can be low, generation of color breaks can be prevented, and a full-color two-dimensional image can be displayed. Further, in one embodiment of the present invention, a two-dimensional image is displayed by synthesizing an image for the odd-numbered rows and an image for the even-numbered rows, so that generation of flickers can be suppressed.

Note that in this embodiment, the case where light having one hue is transmitted to the pixel portion in one field period is described as an example; however, the present invention is not limited to this structure. In one embodiment of the present invention, lights having a plurality of hues may be transmitted to the pixel portion in one field period. When lights having a plurality of hues are transmitted to the pixel portion as described above, images corresponding to the plurality of hues are displayed in parallel in the pixel portion in one field period. With the above structure, images corresponding to different hues can be further effectively prevented from being perceived separately without being synthesized, and generation of color breaks, which has tended to occur in displaying a moving image, can be further prevented.

Next, a method for synchronizing the operation of the pixel portion 105, the operation of the light control portion 109 for the left eye and the light control portion 110 for the right eye in the light-blocking portion 102, and the operation of the light supply portion 104 in the case where a shutter is used for the light control portion 109 for the left eye and the light control portion 110 for the right eye in the liquid crystal display device 100 in FIG. 1 will be described.

Figure 8:
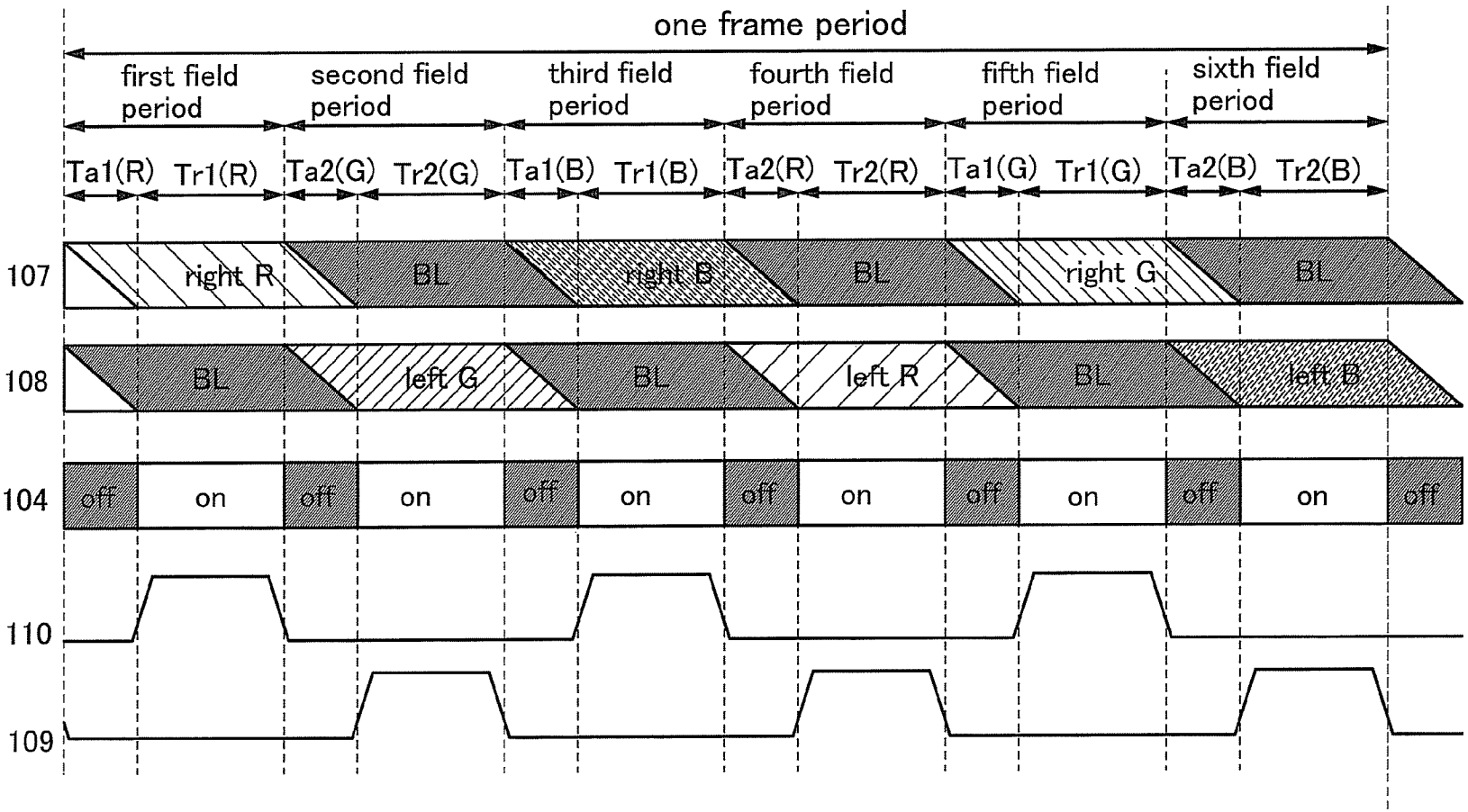
FIG. 8 is a timing chart illustrating operation of a liquid crystal display device.

FIG. 8 is a timing chart illustrating, as an example, the timing of the operation of the first display region 107 and the operation of the second display region 108, the timing of the operation of the light supply portion 104, the timing of change in transmittance of the light control portion 109 for the left eye, and the timing of change in transmittance of the light control portion 110 for the right eye.

First, in the first field period, a writing period Ta1(R) starts, and an image signal of an image for the right eye, which corresponds to red (right R), is written to the pixels 106 included in the first display region 107, and a blanking signal is written to the pixels 106 included in the second display region 108. Then, in the pixels 106 included in the first display region 107, the transmittance of the liquid crystal element is controlled in response to the written image signal. In the pixels 106 included in the second display region 108, the transmittance of the liquid crystal element is controlled in response to the written blanking signal. However, in the above writing period Ta1(R), since the light supply portion 104 is off, neither the first display region 107 nor the second display region 108 displays an image.

Then, in the writing period Ta1(R), the transmittance of the light control portion 109 for the left eye and the light control portion 110 for the right eye is decreased, and neither the light control portion 109 for the left eye nor the light control portion 110 for the right eye transmits light.

Next, a display period Tr1(R) of an image for the right eye, which corresponds to red (right R), starts. In the display period Tr1(R), the light supply portion 104 is turned on, and red light is transmitted to the pixel portion 105. In the pixels 106 included in the first display region 107, the transmittance of the liquid crystal element is controlled in response to an image signal. Therefore, since the light supply portion 104 is turned on, an image for the right eye, which corresponds to red (right R), is displayed in the first display region 107. In the pixels 106 included in the second display region 108, the transmittance of the liquid crystal element is controlled in response to a blanking signal. Consequently, since the light supply portion 104 is turned on, a single gray scale (BL) is displayed in the second display region 108.

Then, in the display period Tr1(R), the transmittance of the light control portion 110 for the right eye becomes high, and the light control portion 110 for the right eye transmits light. On the other hand, the transmittance of the light control portion 109 for the left eye remains low, and the light control portion 109 for the left eye does not transmit light. Therefore, since the light control portion 110 for the right eye transmits light from the pixel portion 105, the image for the right eye (right R) and the single gray scale (BL) displayed in the pixel portion 105 are selectively seen with the right eye of the viewer.

Figure 9A:
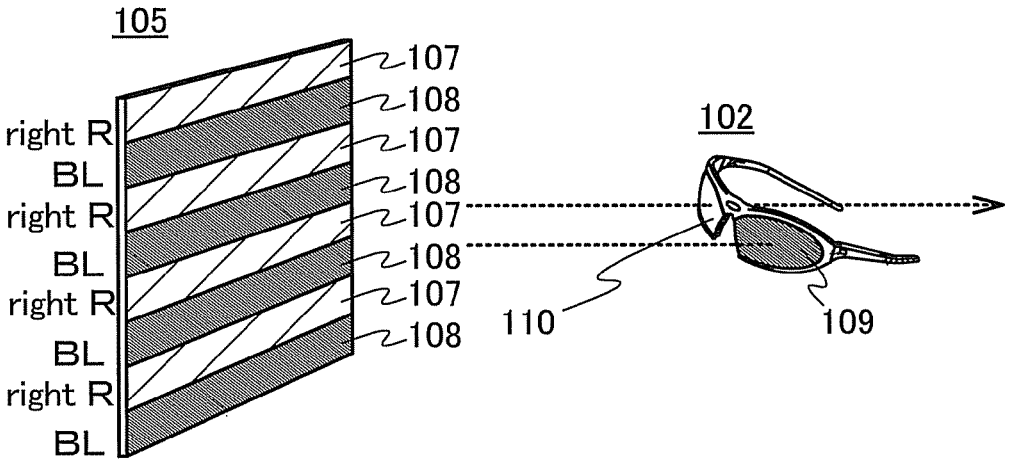
FIGS. 9A to 9C schematically illustrate operation of a pixel portion and a light-blocking portion.

FIG. 9A schematically illustrates the operation of the pixel portion 105 and that of the light-blocking portion 102 in the display period Tr1(R). In FIG. 9A, the light control portion 110 for the right eye transmits light, and the light control portion 109 for the left eye does not transmit light. Therefore, as indicated by dotted lines, light from the pixel portion 105 passes not through the light control portion 109 for the left eye but through the light control portion 110 for the right eye, and is sent to the right eye of the viewer. Consequently, the viewer can see the image for the right eye (right R) displayed in the first display region 107 with his/her right eye.

Next, in the second field period, a writing period Ta2(G) starts, and a blanking signal is written to the pixels 106 included in the first display region 107, and an image signal of an image for the left eye, which corresponds to green (left G), is written to the pixels 106 included in the second display region 108. Then, in the pixels 106 included in the first display region 107, the transmittance of the liquid crystal element is controlled in response to the written blanking signal. In the pixels 106 included in the second display region 108, the transmittance of the liquid crystal element is controlled in response to the written image signal. However, in the above writing period Ta2(G), since the light supply portion 104 is off, neither the first display region 107 nor the second display region 108 displays an image.

Then, in the writing period Ta2(G), the transmittance of the light control portion 109 for the left eye and the light control portion 110 for the right eye is decreased, and neither the light control portion 109 for the left eye nor the light control portion 110 for the right eye transmits light.

Figure 9B:
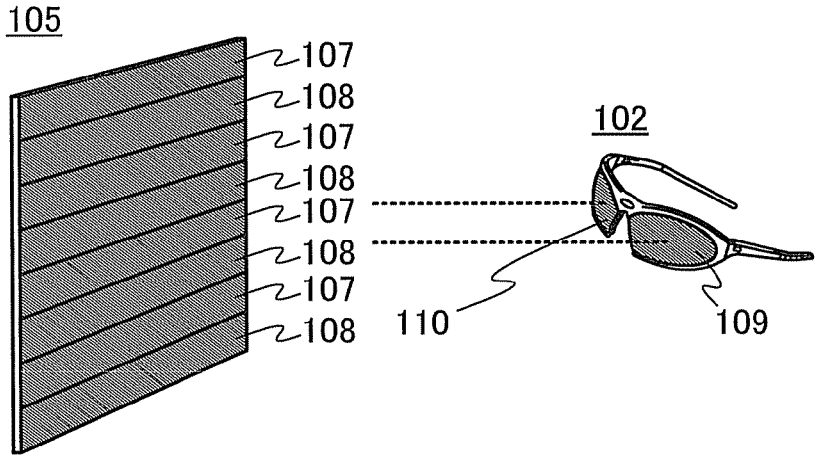

FIG. 9B schematically illustrates the operation of the pixel portion 105 and that of the light-blocking portion 102 in the writing period Ta2(G). In FIG. 9B, neither the light control portion 109 for the left eye nor the light control portion 110 for the right eye transmits light. Therefore, the path of light from the pixel portion 105 to the left eye and the right eye of the viewer is blocked by the light control portion 109 for the left eye and the light control portion 110 for the right eye. In addition, as described above, the light supply portion 104 is off in the writing period Ta2(G). Accordingly, even in the case where the transmittance of the light control portion 109 for the left eye and that of the light control portion 110 for the right eye are not 0% accurately, an image which is made by mixing an image for the left eye, which corresponds to green (left G), and an image for the right eye, which corresponds to red (right R), is not seen with the left eye and the right eye of the viewer.

Next, a display period Tr2(G) of an image for the left eye, which corresponds to green (left G), starts. In the display period Tr2(G), the light supply portion 104 is turned on, and green light is transmitted to the pixel portion 105. In the pixels 106 included in the first display region 107, the transmittance of the liquid crystal element is controlled in response to a blanking signal. Consequently, since the light supply portion 104 is turned on, a single gray scale (BL) is displayed in the first display region 107. In the pixels 106 included in the second display region 108, the transmittance of the liquid crystal element is controlled in response to an image signal. Therefore, since the light supply portion 104 is turned on, an image for the left eye, which corresponds to green (left G), is displayed in the second display region 108.

Then, in the display period Tr2(G), the transmittance of the light control portion 109 for the left eye becomes high, and the light control portion 109 for the left eye transmits light. On the other hand, the transmittance of the light control portion 110 for the right eye remains low, and the light control portion 110 for the right eye does not transmit light. Therefore, since the light control portion 109 for the left eye transmits light from the pixel portion 105, the image for the left eye (left G) and the single gray scale (BL) displayed in the pixel portion 105 are selectively seen with the left eye of the viewer.

Figure 9C:
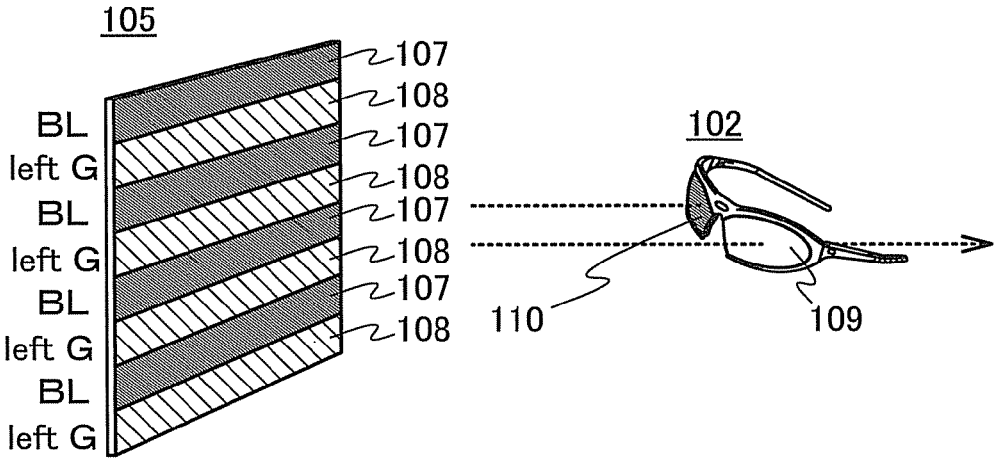

FIG. 9C schematically illustrates the operation of the pixel portion 105 and that of the light-blocking portion 102 in the display period Tr2(G). In FIG. 9C, the light control portion 109 for the left eye transmits light, and the light control portion 110 for the right eye does not transmit light. Therefore, as indicated by dotted lines, light from the pixel portion 105 passes not through the light control portion 110 for the right eye but through the light control portion 109 for the left eye to be sent to the left eye of the viewer. Therefore, the viewer can see an image for the left eye (left G) displayed in the second display region 108 with his/her left eye.

Next, in the third field period, a writing period Ta1(B) and a display period Tr1(B) are sequentially provided. In the writing period Ta1(B) and the display period Tr1(B) in the third field period, the operation of the first display region 107 and the second display region 108, that of the light supply portion 104, and that of the light control portion 109 for the left eye and the light control portion 110 for the right eye are similar to those in the writing period Ta1(R) and the display period Tr1(R) in the first field period. Note that the third field period is different from the first field period in that an image signal of the image for the right eye, which corresponds to blue (right B), is written and the image for the right eye (right B) is displayed. In addition, the third field period is different from the first field period in that light emitted from the light supply portion 104 to the pixel portion 105 in the display period Tr1(B) is blue.

Next, in the fourth field period, a writing period Ta2(R) and a display period Tr2(R) are sequentially provided. In the writing period Ta2(R) and the display period Tr2(R) in the fourth field period, the operation of the first display region 107 and the second display region 108, that of the light supply portion 104, and that of the light control portion 109 for the left eye and the light control portion 110 for the right eye are similar to those in the writing period Ta2(G) and the display period Tr2(G) in the second field period. Note that the fourth field period is different from the second field period in that an image signal of the image for the left eye, which corresponds to red (left R), is written and the image for the left eye (left R) is displayed. In addition, the fourth field period is different from the second field period in that light emitted from the light supply portion 104 to the pixel portion 105 in the display period Tr2(R) is red.

Next, in the fifth field period, a writing period Ta1(G) and a display period Tr1(G) are sequentially provided. In the writing period Ta1(G) and the display period Tr1(G) in the fifth field period, the operation of the first display region 107 and the second display region 108, that of the light supply portion 104, and that of the light control portion 109 for the left eye and the light control portion 1210 for the right eye are similar to those in the writing period Ta1(R) and the display period Tr1(R) in the first field period. Note that the fifth field period is different from the first field period in that an image signal of the image for the right eye, which corresponds to green (right G), is written and the image for the right eye (right G) is displayed. In addition, the fifth field period is different from the first field period in that light emitted from the light supply portion 104 to the pixel portion 105 in the display period Tr1(G) is green.

Next, in the sixth field period, a writing period Ta2(B) and a display period Tr2(B) are sequentially provided. In the writing period Ta2(B) and the display period Tr2(B) in the sixth field period, the operation of the first display region 107 and the second display region 108, that of the light supply portion 104, and that of the light control portion 109 for the left eye and the light control portion 110 for the right eye are similar to those in the writing period Ta2(G) and the display period Tr2(G) in the second field period. Note that the sixth field period is different from the second field period in that an image signal of the image for the left eye, which corresponds to blue (left B), is written and the image for the left eye (left B) is displayed. In addition, the sixth field period is different from the second field period in that light emitted from the light supply portion 104 to the pixel portion 105 in the display period Tr2(B) is blue.

Through one frame period including the first to sixth field periods, the viewer can see a full-color three-dimensional image which is formed using the image for the right eye, which corresponds to red (right R); the image for the left eye, which corresponds to green (left G); the image for the right eye, which corresponds to blue (right B); the image for the left eye, which corresponds to red (left R); the image for the right eye, which corresponds to green (right G); and the image for the left eye, which corresponds to blue (left B).

Note that in the driving method according to one embodiment of the present invention, which is described with reference to FIG. 8 and FIGS. 9A to 9C, the case where a shutter is used for the light control portion 109 for the left eye and the light control portion 110 for the right eye is described as an example; however, the present invention is not limited to this structure. In the case where polarizing plates whose polarization directions are different from each other are used for the light control portion 109 for the left eye and the light control portion 110 for the right eye, a blanking signal is not necessarily written to the pixel portion 105. That is, in each field period, an image signal may be written to the pixels 106 in at least one of the first display region 107 and the second display region 108.

Note that in the above driving method, a structure in which light sources corresponding to three colors, red (R), green (G), and blue, (B) are used for the light supply portion is described; however, a driving method according to one embodiment of the present invention is not limited to this structure. That is, in a driving method according to one embodiment of the present invention, a light source supplying light having a given color can be used for the light supply portion. For example, a combination of light sources of four colors, red (R), green (G), blue (B), and white (W), a combination of light sources of four colors, red (R), green (G), blue (B), and yellow (Y), a combination of light sources of three colors, cyan (C), magenta (M), and yellow (Y), or the like can be used for the light supply portion.

In addition, a light source emitting white (W) light may further be provided in the light supply portion instead of forming white (W) light by mixing colors. The light source emitting white (W) light has high emission efficiency; therefore, with the use of the light supply portion formed using the light source, power consumption can be reduced. In the case where the light supply portion includes light sources of two complementary colors (for example, in the case where the light supply portion includes light sources of two colors, blue (B) and yellow (Y)), the two colors are mixed; thus, white (W) light can be formed. Alternatively, a combination of light sources of six colors, pale red (R), pale green (G), pale blue (B), deep red (R), deep green (G), and deep blue (B), a combination of light sources of six colors, red (R), green (G), blue (B), cyan (C), magenta (M), and yellow (Y), or the like can be used.

Note that, for example, colors that can be expressed using the light sources of red (R), green (G), and blue (B) are limited to colors existing in the triangle made by the three points on the chromaticity diagram which correspond to the emission colors of the respective light sources. Therefore, by additionally providing a light source of a color existing outside the triangle on the chromaticity diagram, the range of the colors which can be expressed in the liquid crystal display device can be expanded, so that color reproducibility can be enhanced.

For example, in addition to the light sources of red (R), green (G), and blue (B), a light source emitting the following color can be used for the light supply portion: deep blue (DB) represented by a point positioned substantially outside the triangle in a direction from the center of the chromaticity diagram toward the point on the chromaticity diagram corresponding to the blue-light-emitting element B; or deep red (DR) represented by a point positioned substantially outside the triangle in a direction from the center of the chromaticity diagram toward the point corresponding to red (R) on the chromaticity diagram.

Note that the response time of liquid crystal exhibiting a blue phase is as small as 1 msec or less, as described above. Therefore, with the use of liquid crystal exhibiting a blue phase for a liquid crystal layer, an image signal can be rapidly written to a pixel, and the frame frequency can be increased. In particular, as in one embodiment of the present invention, in the case of a driving method in which one frame period includes a plurality of field periods, an image signal is written to a pixel portion more frequently than that in a color filter method; thus, the frame frequency is likely to be lowered. However, in a liquid crystal display device using a driving method according to one embodiment of the present invention, liquid crystal exhibiting a blue phase is used for a liquid crystal layer included in a liquid crystal element, whereby the frame frequency can be prevented from being lowered and generation of color breaks and flickers can be prevented.

Embodiment 2

A structure of an image display portion of a liquid crystal display device in which a driving method according to one embodiment of the present invention is used will be described.

Figure 10:
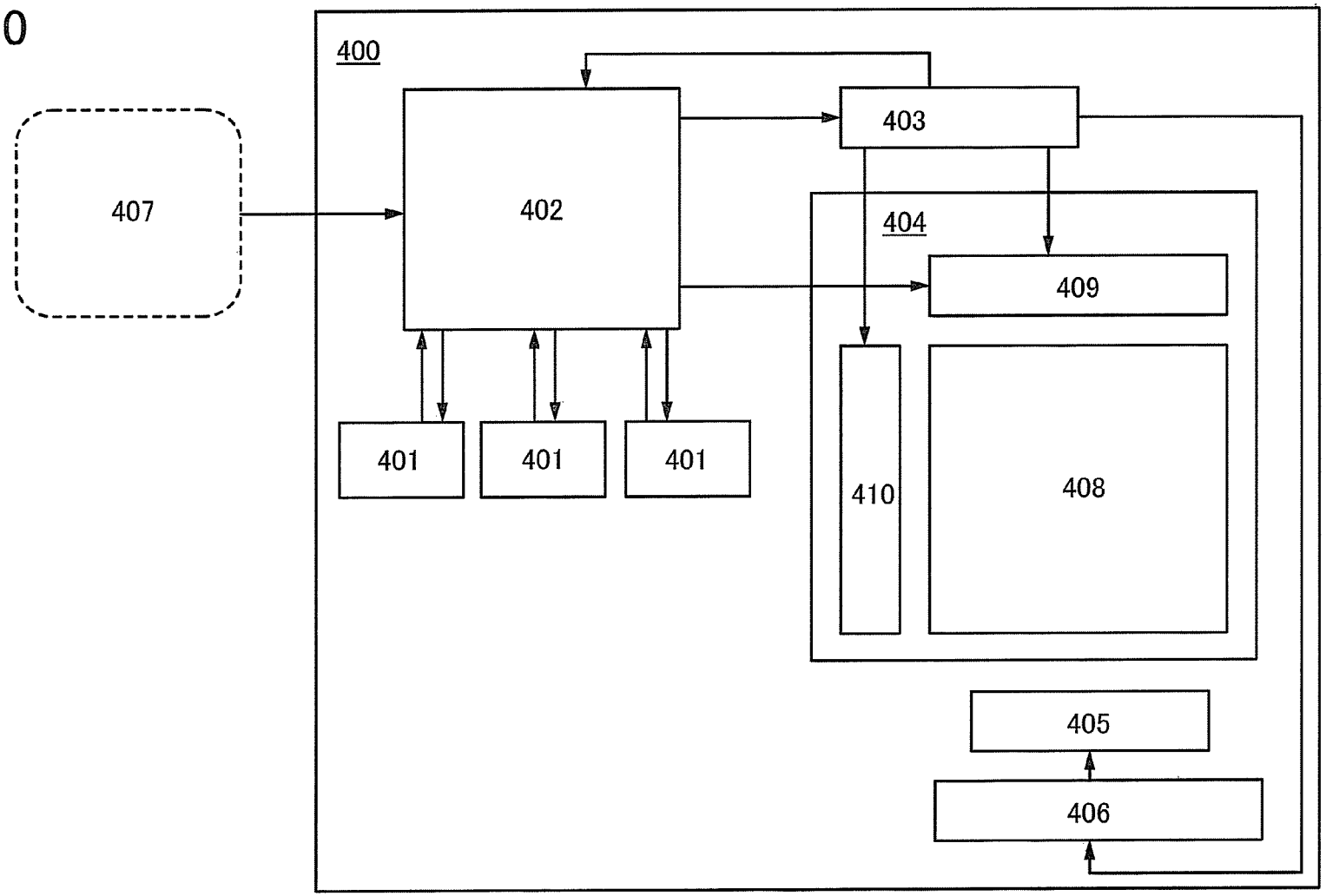
FIG. 10 is a block diagram of an image display portion.

FIG. 10 is a block diagram showing an example of a structure of an image display portion 400. Although the block diagram shows elements classified according to their functions in independent blocks, it may be practically difficult to completely separate the elements according to their functions and, in some cases, one element may be involved in a plurality of functions.

As illustrated in FIG. 10, the image display portion 400 of this embodiment includes a plurality of image memories 401, an image processing circuit 402, a controller 403, a panel 404, a light supply portion 405, and a light supply portion control circuit 406.

Image data corresponding to a full-color image (full-color image data 407) is input to the image display portion 400. The image processing circuit 402 performs writing of the full-color image data 407 to the plurality of image memories 401 and reading of the full-color image data 407 from the plurality of image memories 401. The full-color image data 407 includes image data corresponding to a plurality of hues. Image data corresponding to the plurality of hues are stored in the respective image memories 401.

As the image memories 401, for example, memory circuits such as dynamic random access memories (DRAMs) or static random access memories (SRAMs) can be used. Alternatively, as the image memories 401, video RAMs (VRAMs) may be used.

Image data corresponding to the respective hues, which are stored in the plurality of image memories 401, are read by the image processing circuit 402 according to instruction from the controller 403. Image data corresponding to the respective hues, which are read from the plurality of image memories 401, are transmitted to the panel 404.

In addition, the controller 403 supplies the panel 404 with a driving signal which is synchronized with the full-color image data 407 or a power supply potential which is to be used when the full-color image is displayed.

The panel 404 includes a pixel portion 408 in which each pixel includes a liquid crystal element and driver circuits such as a signal line driver circuit 409 and a scan line driver circuit 410. Image data corresponding to the respective hues, which are input to the panel 404, are transmitted to the signal line driver circuit 409. A driving signal or a power supply potential from the controller 403 is supplied to the signal line driver circuit 409 or the scan line driver circuit 410.

Note that the driving signal includes a signal line driver circuit start pulse signal SSP and a signal line driver circuit clock signal SCK which control the operation of the signal line driver circuit 409, a latch signal LP, a scan line driver circuit start pulse GSP and a scan line driver circuit clock signal GCK which control the operation of the scan line driver circuit 410, and the like.

A plurality of light sources emitting different hues are provided in the light supply portion 405. The controller 403 controls driving of the light sources in the light supply portion 405 through the light supply portion control circuit 406.

Next, structures of the signal line driver circuit 409 and the scan line driver circuit 410 included in the panel 404 will be described.

Figure 11:
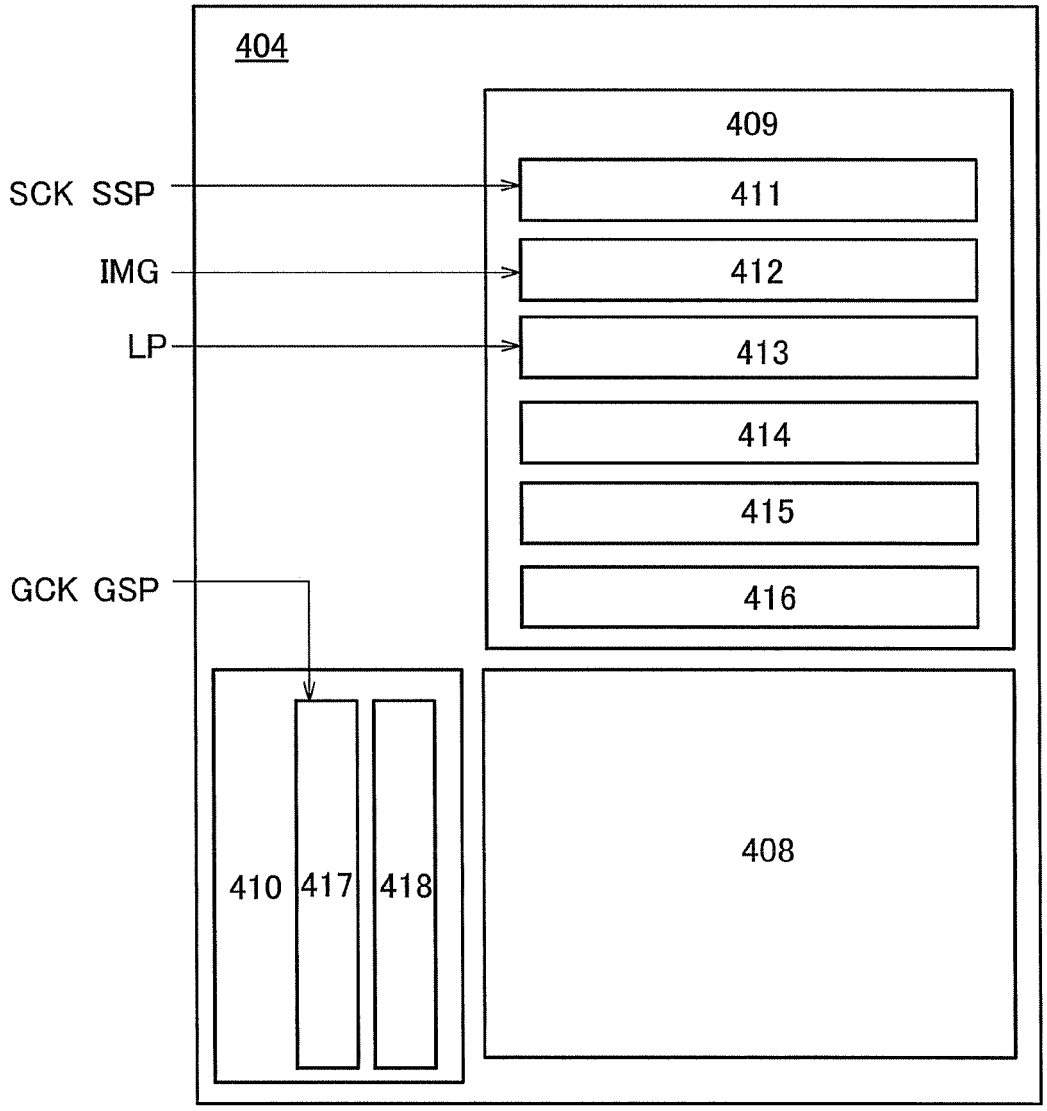
FIG. 11 is a block diagram of a panel.

FIG. 11 is a block diagram showing an example of a structure of the panel 404. The panel 404 in FIG. 11 includes, as described above, the pixel portion 408, the signal line driver circuit 409, and the scan line driver circuit 410. The signal line driver circuit 409 includes a shift register 411, a first memory circuit 412, a second memory circuit 413, a level shifter 414, a DAC 415, and an analog buffer 416. The scan line driver circuit 410 includes a shift register 417 and a digital buffer 418.

Next, the operation of the panel 404 illustrated in FIG. 11 will be described. When a start pulse signal SSP and a clock signal SCK are input to the shift register 411, the shift register 411 generates a timing signal whose pulse is sequentially shifted.

An image signal IMG is input to the first memory circuit 412. When the timing signal is input to the first memory circuit 412, the image signal IMG is sampled in response to a pulse of the timing signal and sequentially written to a plurality of memory elements included in the first memory circuit 412. That is, the image signal IMG which is input to the signal line driver circuit 409 in series is written to the first memory circuit 412 in parallel. The image signal IMG written to the first memory circuit 412 is held.

Note that the image signal IMG may be sequentially written to a plurality of memory elements included in the first memory circuit 412; or so-called division driving may be performed, in which the plurality of memory elements included in the first memory circuit 412 are divided into several groups and the image signal IMG is input to the groups in parallel. Note that the number of memory elements in each group is referred to as the number of divisions. For example, in the case where a memory circuit is divided into groups so that each group has four memory elements, division driving is performed with four divisions.

A latch signal LP is input to the second memory circuit 413. After writing of the image signal IMG to the first memory circuit 412 is completed, the image signal IMG held in the first memory circuit 412 is written to the second memory circuit 413 and held therein all at once in response to a pulse of a latch signal LP input to the second memory circuit 413 in a blanking period (a flyback period). Again, in response to the timing signal from the shift register 411, the next image signal IMG is sequentially written to the first memory circuit 412 in which transmission of the image signal IMG to the second memory circuit 413 has been completed. In the one line period of the second round, the image signal IMG which is written to and held in the second memory circuit 413 is transmitted to the DAC 415 after the amplitude of the voltage is adjusted in the level shifter 414. In the DAC 415, the image signal IMG which is input is converted from a digital signal to an analog signal. Then, the image signal IMG which is converted to an analog signal is transmitted to the analog buffer 416. The image signal IMG transmitted from the DAC 415 is transmitted from the analog buffer 416 to the pixel portion 408 through a signal line.

In contrast, in the scan line driver circuit 410, when a start signal GSP and a clock signal GCK are input to the shift register 417, a scan signal SCN whose pulse is sequentially shifted is generated. The scan signal SCN output from the shift register 417 is transmitted from the digital buffer 418 to the pixel portion 408 through a scan line.

The pixel included in the pixel portion 408 is selected by the scan signal SCN input from the scan line driver circuit 410. The image signal IMG transmitted from the signal line driver circuit 409 to the pixel portion 408 through the signal line is input to the above-described selected pixel.

In the panel 404 illustrated in FIG. 11, the start pulse signal SSP, the clock signal SCK, the latch signal LP, and the like correspond to driving signals of the signal line driver circuit 409. In addition, the start pulse signal GSP, the clock signal GCK, and the like correspond to driving signals of the scan line driver circuit 410.

This embodiment can be implemented in combination with any of the above embodiments as appropriate.

Embodiment 3

In this embodiment, a specific structure of a pixel in the case where liquid crystal exhibiting a blue phase is used for a liquid crystal layer included in a liquid crystal element will be described.

Figure 12A:
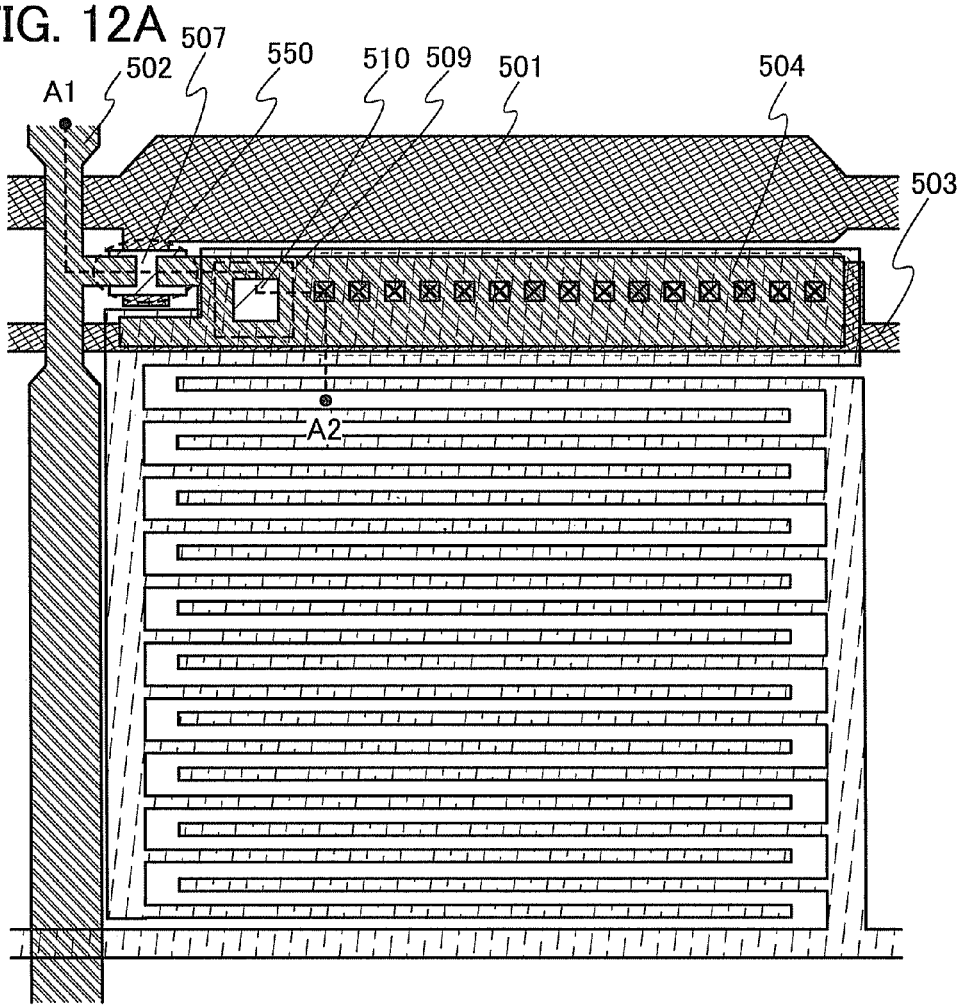
FIGS. 12A and 12B are a top view and a cross-sectional view of a pixel, respectively.
Figure 12B:
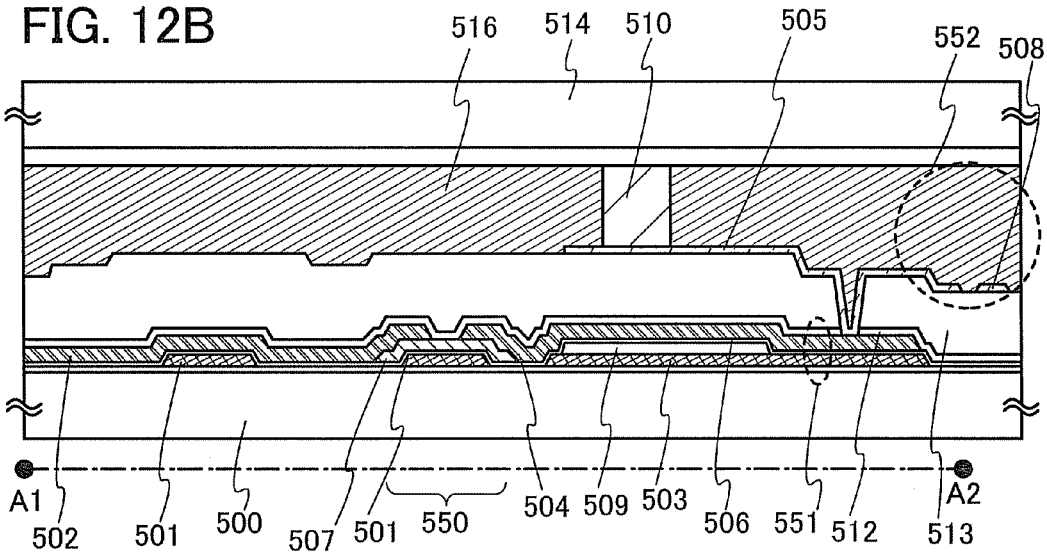

FIG. 12A is an example of a top view of a pixel. FIG. 12B is a cross-sectional view taken along broken line A1-A2 of FIG. 12A.

The pixel illustrated in FIGS. 12A and 12B includes a conductive film 501 functioning as a scan line, a conductive film 502 functioning as a signal line, a conductive film 503 functioning as a capacitor wiring, and a conductive film 504 functioning as a second terminal of a transistor 550 functioning as a switching element. The conductive film 501 also functions as a gate electrode of the transistor 550. In addition, the conductive film 502 also functions as a first terminal of the transistor 550.

The conductive film 501 and the conductive film 503 can be formed by processing one conductive film formed over a substrate 500 having an insulating surface into a desired shape. A gate insulating film 506 is formed over the conductive film 501 and the conductive film 503. Further, the conductive film 502 and the conductive film 504 can be formed by processing one conductive film formed over the gate insulating film 506 into a desired shape.

An active layer 507 of the transistor 550 is formed over the gate insulating film 506 so as to overlap with the conductive film 501. Further, an insulating film 512 and an insulating film 513 are sequentially formed so as to cover the active layer 507, the conductive film 502, and the conductive film 504. In addition, a pixel electrode 505 and a common electrode 508 are formed over the insulating film 513, and the conductive film 504 is connected to the pixel electrode 505 through a contact hole formed in the insulating film 512 and the insulating film 513.

Note that a portion where the conductive film 503 functioning as a capacitor wiring overlaps with the conductive film 504 with the gate insulating film 506 provided therebetween functions as a capacitor 551.

In this embodiment, an insulating film 509 is formed between the conductive film 503 and the gate insulating film 506. In addition, a spacer 510 is formed over the pixel electrode 505 so as to overlap with the insulating film 509.

FIG. 12A is a top view of the pixel just after the step for forming the spacer 510. FIG. 12B illustrates the state where a substrate 514 is provided so as to face the substrate 500 over which components up to the spacer 510 are formed.

A liquid crystal layer 516 including liquid crystal is provided between the substrate 514, and the pixel electrode 505 and the common electrode 508. A liquid crystal element 552 is formed in a region including the pixel electrode 505, the common electrode 508, and the liquid crystal layer 516.

The pixel electrode 505 and the common electrode 508 can be formed using a light-transmitting conductive material such as indium tin oxide containing silicon oxide (ITSO), indium tin oxide (ITO), zinc oxide (ZnO), indium zinc oxide, or zinc oxide to which gallium is added (GZO), for example.

Injection of liquid crystal for forming the liquid crystal layer 516 may be performed by a dispenser method (dripping method) or a dipping method (pumping method).

Note that the substrate 514 may be provided with a light-blocking film capable of blocking light, in order to prevent a disclination due to disordered orientation of the liquid crystal between pixels or in order to prevent dispersed light from entering a plurality of adjacent pixels. An organic resin containing black pigment such as carbon black or low-valent titanium oxide whose oxidation number is smaller than that of titanium dioxide can be used for the light-blocking film. Alternatively, a film of chromium can be used for the light-blocking film.

Like the liquid crystal element 552 illustrated in FIGS. 12A and 12B, an IPS liquid crystal element or a liquid crystal element exhibiting a blue phase has a structure including the liquid crystal layer 516 over the pixel electrode 505 and the common electrode 508. However, a liquid crystal display device according to one embodiment of the present invention may have a structure in which a liquid crystal layer is provided between a pixel electrode and a common electrode in a liquid crystal element, instead of this structure.

Note that in the transistor 550, the active layer 507 may include a wide-gap semiconductor such as an oxide semiconductor or may include an amorphous, microcrystalline, polycrystalline, or single crystal semiconductor of silicon, germanium, or the like.

An oxide semiconductor has a wider band gap and lower intrinsic carrier density than silicon. Therefore, a transistor using an oxide semiconductor in its active layer can have an extremely low off-state current compared with a transistor using a normal semiconductor such as silicon or germanium in its active layer.

Note that a purified oxide semiconductor (purified OS) obtained by reduction of impurities such as moisture or hydrogen which serves as an electron donor (donor) and by reduction of oxygen defects is an intrinsic (i-type) semiconductor or a substantially i-type semiconductor. Therefore, a transistor including the oxide semiconductor has a characteristic of significantly small off-state current. Specifically, the concentration of hydrogen in the purified oxide semiconductor which is measured by secondary ion mass spectrometry (SIMS) is less than or equal to $5\times10^{19}/cm^3$, preferably less than or equal to $5\times10^{18}/cm^3$, further preferably less than or equal to $5\times10^{17}/cm^3$, still further preferably less than or equal to $1\times10^{16}/cm^3$. The carrier density of an oxide semiconductor film, which can be measured by Hall effect measurement, is less than $1\times10^{14}/cm^3$, preferably less than $1\times10^{12}/cm^3$, further preferably less than $1\times10^{11}/cm^3$. The band gap of the oxide semiconductor is 2 eV or more, preferably 2.5 eV or more, or further preferably 3 eV or more. With the use of the oxide semiconductor film which is purified by sufficiently reducing the concentration of impurities such as moisture or hydrogen, off-state current of the transistor can be reduced.

The analysis of the concentration of hydrogen in an oxide semiconductor film is described here. The concentration of hydrogen in the semiconductor film is measured by SIMS. Because of the principle of SIMS, it is known that accurate data in the proximity of a surface of a sample or in the proximity of an interface between stacked films formed of different materials is difficult to obtain. Thus, in the case where the distribution of the hydrogen concentration in the thickness direction of a film is analyzed by SIMS, the average value of the hydrogen concentration in a region of the film where substantially the same value can be obtained without significant variation is employed as the hydrogen concentration. Further, in the case where the thickness of the film to be measured is small, a region where substantially the same value can be obtained cannot be found in some cases due to the influence of the hydrogen concentration of an adjacent film. In this case, the maximum value or the minimum value of the hydrogen concentration in a region where the film is provided is employed as the hydrogen concentration in the film. Furthermore, in the case where a mountain-shaped peak having the maximum value and a valley-shaped peak having the minimum value do not exist in the region where the film is provided, the value of the inflection point is employed as the hydrogen concentration.

Various experiments can actually prove small off-state current of the transistor including the purified oxide semiconductor film as an active layer. For example, even with an element with a channel width of $1\times10^6$ μm and a channel length of 10 μm, in a range of from 1 V to 10 V of voltage (drain voltage) between a source terminal and a drain terminal, off-state current can be less than or equal to the measurement limit of a semiconductor parameter analyzer, that is, less than or equal to $1\times10^{-13}$ A. In that case, it can be found that an off-state current density corresponding to a value obtained by dividing the off-state current by the channel width of the transistor is less than or equal to 100 zA/μm.

Note that as the oxide semiconductor, an indium oxide, a tin oxide, a zinc oxide, a two-component metal oxide such as an In—Zn-based oxide, a Sn—Zn-based oxide, an Al—Zn-based oxide, a Zn—Mg-based oxide, a Sn—Mg-based oxide, an In—Mg-based oxide, or an In—Ga-based oxide, a three-component metal oxide such as an In—Ga—Zn-based oxide (also referred to as IGZO), an In—Al—Zn-based oxide, an In—Sn—Zn-based oxide, a Sn—Ga—Zn-based oxide, an Al—Ga—Zn-based oxide, a Sn—Al—Zn-based oxide, an In—Hf—Zn-based oxide, an In—La—Zn-based oxide, an In—Ce—Zn-based oxide, an In—Pr—Zn-based oxide, an In—Nd—Zn-based oxide, an In—Sm—Zn-based oxide, an In—Eu—Zn-based oxide, an In—Gd—Zn-based oxide, an In—Tb—Zn-based oxide, an In—Dy—Zn-based oxide, an In—Ho—Zn-based oxide, an In—Er—Zn-based oxide, an In—Tm—Zn-based oxide, an In—Yb—Zn-based oxide, or an In—Lu—Zn-based oxide, a four-component metal oxide such as an In—Sn—Ga—Zn-based oxide, an In—Hf—Ga—Zn-based oxide, an In—Al—Ga—Zn-based oxide, an In—Sn—Al—Zn-based oxide, an In—Sn—Hf—Zn-based oxide, or an In—Hf—Al—Zn-based oxide can be used. In this specification, for example, the term "In—Sn—Ga—Zn-based oxide semiconductor" means a metal oxide containing indium (In), tin (Sn), gallium (Ga), and zinc (Zn) and may have any stoichiometric ratio. The oxide semiconductor may contain silicon.

The oxide semiconductor may be expressed by the chemical formula, $InMO_3(ZnO)_m$, (m>0, m is not necessarily a natural number). Here, M represents one or more metal elements selected from Ga, Al, Mn, and Co.

Unless otherwise specified, in the case of an n-channel transistor, the off-state current in this specification is a current which flows between a source terminal and a drain terminal when, in the state where the potential of the drain terminal is greater than that of the source terminal and that of a gate electrode, the potential of the gate electrode is less than or equal to zero with respect to the potential of the source terminal. Alternatively, in this specification, in the case of a p-channel transistor, the off-state current is a current which flows between a source terminal and a drain terminal when, in the state where the potential of the drain terminal is less than that of the source terminal and that of a gate electrode, the potential of the gate electrode is greater than or equal to zero with respect to the potential of the source terminal.

As an example of a semiconductor material whose band gap is wider than that of silicon and whose intrinsic carrier density is lower than that of silicon, a compound semiconductor such as silicon carbide (SiC) or gallium nitride (GaN) as well as an oxide semiconductor can be used. An oxide semiconductor has an advantage of high mass productivity because it can be formed by sputtering or a wet process (e.g., a printing method), unlike a compound semiconductor such as silicon carbide or gallium nitride. In addition, the deposition temperature of an oxide semiconductor is 300° C. to 500° C. (the glass transition temperature or less, and approximately 700° C. at a maximum) whereas the process temperature of silicon carbide and process temperature of gallium nitride are approximately 1500° C. and approximately 1100° C., respectively. Therefore, an oxide semiconductor can be formed over a glass substrate which is inexpensively available and it is possible to stack a semiconductor element formed using an oxide semiconductor over an integrated circuit using a semiconductor material which does not have heat resistance high enough to withstand heat treatment at 1500° C. to 2000° C. An oxide semiconductor is applicable to a large-sized substrate of the sixth or later generation, unlike silicon with crystallinity such as polycrystalline silicon or microcrystalline silicon, silicon carbide, gallium nitride, and the like. Accordingly, an oxide semiconductor particularly has an advantage of high mass productivity. Further, in the case where an oxide semiconductor with crystallinity is used in order to improve the property (e.g., mobility) of a transistor, the oxide semiconductor with crystallinity can be easily obtained by heat treatment at 250° C. to 800° C.

In the liquid crystal display device, by inversion driving in which the polarity of the potential of an image signal is inverted with respect to the potential of the common electrode, deterioration of liquid crystal called burn-in can be prevented. However, in the inversion driving, the change in the potential supplied to the signal line is increased at the time of changing the polarity of the image signal; thus, a potential difference between a source terminal and a drain terminal of the transistor 550 which functions as a switching element is increased. In particular, in the case where the liquid crystal layer includes liquid crystal exhibiting a blue phase, the potential difference is significantly large. For example, in the case where the liquid crystal layer includes TN liquid crystal, the potential difference is about 10 V; in the case where the liquid crystal layer includes liquid crystal exhibiting a blue phase, the potential difference is as large as several tens of volts or more. Accordingly, in the transistor 550, a deterioration of characteristics such as a shift of threshold voltage is easily caused. Furthermore, in order to maintain the voltage held in the liquid crystal element, the off-state current needs to be low even when the potential difference between the source terminal and the drain terminal is large. A semiconductor whose band gap is larger than that of silicon or germanium and whose intrinsic carrier density is lower than that of silicon or germanium, such as an oxide semiconductor, is used for the transistor 550; therefore, the resistance of the transistor 550 to a high voltage can be increased and the off-state current can be made considerably low. Therefore, as compared to the case of using a transistor including a normal semiconductor material such as silicon or germanium, deterioration of the transistor 550 can be prevented and the voltage held in the liquid crystal element can be maintained.

Note that the transistor 550 includes at least a gate electrode on one side of the active layer 507. Alternatively, the transistor 550 may include a pair of gate electrodes with the active layer 507 interposed therebetween. In addition, the transistor 550 may be either a single-gate transistor which includes a single gate electrode and a single channel formation region, or a multi-gate transistor which includes a plurality of gate electrodes electrically connected to each other and thus includes a plurality of channel formation regions.

As a material of the conductive films 501 to 504, any of the following materials can be used: an element selected from aluminum, chromium, copper, tantalum, titanium, molybdenum, or tungsten; an alloy including any of these elements; an alloy film including the above elements in combination; and the like. Alternatively, a structure may be employed in which a film of a refractory metal such as chromium, tantalum, titanium, molybdenum, or tungsten is stacked over or below a metal film of aluminum or copper. Aluminum or copper is preferably used in combination with a refractory metal material in order to prevent a heat resistance problem and a corrosive problem. As the refractory metal material, molybdenum, titanium, chromium, tantalum, tungsten, neodymium, scandium, yttrium, or the like can be used. A Cu—Mg—Al alloy, a Mo—Ti alloy, Ti, and Mo have high adhesiveness with an oxide film. Therefore, for the conductive films 501 to 504, a stacked structure is employed in which a conductive film including a Cu—Mg—Al alloy, a Mo—Ti alloy, Ti, or Mo is used for the lower layer and a conductive film including Cu is used for the upper layer; thus, the adhesiveness between an insulating film which is an oxide film and the conductive films 501 to 504 can be increased.

In the case where an oxide semiconductor film is used for the active layer 507, the oxide semiconductor film is formed in such a manner that the substrate is held in a treatment chamber kept at reduced pressure, a sputtering gas from which hydrogen and moisture are removed is introduced into the treatment chamber while residual moisture therein is removed, and a target is used. The substrate temperature in film formation may be higher than or equal to 100° C. and lower than or equal to 600° C., preferably higher than or equal to 200° C. and lower than or equal to 400° C. By forming the oxide semiconductor film in a state where the substrate is heated, the concentration of impurities contained in the formed oxide semiconductor film can be reduced. In addition, damage by sputtering can be reduced. In order to remove residual moisture in the treatment chamber, an entrapment vacuum pump is preferably used. For example, a cryopump, an ion pump, or a titanium sublimation pump is preferably used. The evacuation unit may be a turbo pump provided with a cold trap. In the film formation chamber which is evacuated with the cryopump, for example, a hydrogen atom, a compound containing a hydrogen atom, such as water ($H_2O$), (preferably, also a compound containing a carbon atom), and the like are removed, whereby the concentration of impurities contained in the oxide semiconductor film formed in the film formation chamber can be reduced.

Moreover, when the leakage rate of the treatment chamber of the sputtering apparatus is set to $1\times10^{-10}$ Pa·m$^3$/second or lower, entry of impurities such as alkali metal or hydride into the oxide semiconductor film that is being formed by a sputtering method can be reduced. Further, with the use of the above entrapment vacuum pump as an evacuation system, counter flow of impurities such as alkali metal, a hydrogen atom, a hydrogen molecule, water, a hydroxyl group, or hydride from the evacuation system can be reduced.

When the purity of the target is set to 99.99% or higher, alkali metal, a hydrogen atom, a hydrogen molecule, water, a hydroxyl group, hydride, or the like entering the oxide semiconductor film can be reduced. In addition, when the target is used, the concentration of alkali metal such as lithium, sodium, or potassium can be reduced in the oxide semiconductor film.

Note that, in some cases, the oxide semiconductor film formed by sputtering or the like includes a large amount of moisture or hydrogen (including a hydroxyl group) as impurities. Moisture and hydrogen easily form a donor level and thus serve as impurities in the oxide semiconductor. In order to reduce impurities such as moisture or hydrogen in the oxide semiconductor film (dehydration or dehydrogenation), the oxide semiconductor film is preferably subjected to heat treatment in a reduced-pressure atmosphere, an inert gas atmosphere of nitrogen, a rare gas, or the like, an oxygen gas atmosphere, or an ultra dry air atmosphere (the moisture amount is 20 ppm (−55° C. by conversion into a dew point) or less, preferably 1 ppm or less, further preferably 10 ppb or less, in the case where the measurement is performed by a dew point meter in a cavity ring down laser spectroscopy (CRDS) method).

By performing heat treatment on the oxide semiconductor film, moisture or hydrogen in the oxide semiconductor film can be eliminated. Specifically, heat treatment may be performed at a temperature higher than or equal to 250° C. and lower than or equal to 750° C., preferably higher than or equal to 400° C. and lower than the strain point of the substrate. For example, heat treatment may be performed at 500° C. for approximately 3 minutes to 6 minutes. When an RTA method is used for the heat treatment, dehydration or dehydrogenation can be performed in a short time; therefore, treatment can be performed even at a temperature higher than the strain point of a glass substrate.

Note that a heat treatment apparatus is not limited to an electrical furnace, and may include a device for heating a process object by heat conduction or heat radiation from a heating element such as a resistance heating element. For example, an RTA (rapid thermal anneal) apparatus such as a GRTA (gas rapid thermal anneal) apparatus or an LRTA (lamp rapid thermal anneal) apparatus can be used. An LRTA apparatus is an apparatus for heating an object to be processed by radiation of light (an electromagnetic wave) emitted from a lamp such as a halogen lamp, a metal halide lamp, a xenon arc lamp, a carbon arc lamp, a high-pressure sodium lamp, or a high-pressure mercury lamp. A GRTA apparatus is an apparatus for heat treatment using a high-temperature gas. As the gas, an inert gas which does not react with an object to be processed by heat treatment, such as nitrogen or a rare gas like argon, is used.

In the heat treatment, it is preferable that moisture, hydrogen, or the like be not contained in nitrogen or a rare gas such as helium, neon, or argon. It is preferable that the purity of nitrogen or a rare gas such as helium, neon, or argon which is introduced into the heat treatment apparatus be set to be 6N (99.9999%) or higher, preferably 7N (99.99999%) or higher (that is, the impurity concentration is 1 ppm or less, preferably 0.1 ppm or less).

It has been pointed out that an oxide semiconductor is insensitive to impurities, there is no problem even when a considerable amount of metal impurities is contained in the film, and therefore, soda-lime glass which contains a large amount of alkali metal such as sodium and is inexpensive can also be used (Kamiya, Nomura, and Hosono, "Carrier Transport Properties and Electronic Structures of Amorphous Oxide Semiconductors: The present status", *KOTAI BUTSURI* (*SOLID STATE PHYSICS*), 2009, Vol. 44, pp. 621-633). However, this is not a proper consideration. Alkali metal is not an element included in an oxide semiconductor, and therefore, is an impurity. Also, alkaline-earth metal is an impurity in the case where alkaline-earth metal is not an element included in an oxide semiconductor. Alkali metal, in particular, Na becomes $Na^+$ when an insulating film in contact with the oxide semiconductor film is an oxide and Na diffuses into the insulating film. Further, in the oxide semiconductor film, Na cuts or enters a bond between metal and oxygen which are included in the oxide semiconductor. As a result, for example, deterioration of characteristics of the transistor, such as a normally-on state of the transistor due to shift of a threshold voltage in the negative direction, or reduction in mobility, occurs. In addition, variation in characteristics also occurs. Such deterioration of characteristics of the transistor and variation in characteristics due to the impurity remarkably appear when the hydrogen concentration in the oxide semiconductor film is very low. Therefore, when the hydrogen concentration in the oxide semiconductor film is less than or equal to $1\times10^{18}$/cm$^3$, preferably less than or equal to $1\times10^{17}$/cm$^3$, the concentration of the above impurity is preferably reduced. Specifically, the Na concentration measured by secondary ion mass spectrometry is preferably less than or equal to $5\times10^{16}$/cm$^3$, more preferably less than or equal to $1\times10^{16}$/cm$^3$, still more preferably less than or equal to $1\times10^{15}$/cm$^3$. In a similar manner, the measurement value of Li concentration is preferably less than or equal to $5\times10^{15}$/cm$^3$, more preferably less than or equal to $1\times10^{15}$/cm$^3$. In a similar manner, the measurement value of K concentration is preferably less than or equal to $5\times10^{15}$/cm$^3$, more preferably less than or equal to $1\times10^{15}$/cm$^3$.

Reducing the hydrogen concentration in the oxide semiconductor film to highly purify the oxide semiconductor film leads to stabilization of the oxide semiconductor film. In addition, heat treatment at a temperature lower than or equal to the glass transition temperature makes it possible to form an oxide semiconductor film with a wide band gap in which the density of carriers generated due to a hydrogen defect is low. Therefore, the transistor can be manufactured using a large-sized substrate, so that the productivity can be increased. The above heat treatment can be performed at any time after the oxide semiconductor film is formed.

Note that the oxide semiconductor film may be amorphous or may have crystallinity. As an oxide semiconductor film having crystallinity, an oxide including a crystal with c-axis alignment (also referred to as CAAC: c axis aligned crystal) is also preferable because the effect of improving the reliability of a transistor can be obtained.

Sputtering may be performed to form an oxide semiconductor film including CAAC. In order to obtain CAAC by sputtering, it is important to form hexagonal crystals in an initial stage of deposition of an oxide semiconductor film and cause crystal growth from the hexagonal crystals as seeds. In order to achieve this, if is preferable that the distance between the target and the substrate be made longer (e.g., 150 mm to 200 mm) and the substrate heating temperature be 100° C. to 500° C., more preferably 200° C. to 400° C., still preferably 250° C. to 300° C. In addition to this, the deposited oxide semiconductor film is subjected to heat treatment at a temperature higher than the substrate heating temperature in the deposition, so that micro-defects in the film and defects at the interface of a stacked layer can be compensated.

Specifically, CAAC has a hexagonal crystal structure including zinc, in which bonds for forming hexagonal lattices are formed in the a-b plane which is parallel to a surface of the insulating film and c-axes are substantially perpendicular to the a-b plane.

In CAAC, metal atoms and oxygen atoms are bonded in an orderly manner in comparison with an amorphous oxide semiconductor. In other words, in the case where an oxide semiconductor is amorphous, the coordination number may vary according to the kind of metal atom. In contrast, in the case of CAAC, the coordination numbers of metal atoms are substantially the same. Accordingly, microscopic oxygen defects can be reduced, and instability and charge transfer due to release of or bond to a hydrogen atom (including a hydrogen ion) or an alkali metal atom can be reduced.

Therefore, a transistor is formed using an oxide semiconductor film including CAAC, whereby the amount of change in the threshold voltage of the transistor between before and after light irradiation and a bias-temperature stress (BT) test performed on the transistor can be reduced. Accordingly, a transistor having stable electrical characteristics can be manufactured.

In the case where the active layer 507 is formed using an oxide semiconductor film, insulating films in contact with the oxide semiconductor film, such as the gate insulating film 506 and the insulating film 512, can be formed using a single layer or a stacked layer using silicon oxide, silicon nitride oxide, silicon oxynitride, silicon nitride, hafnium oxide, aluminum oxide, tantalum oxide, yttrium oxide, hafnium silicate ($HfSi_xO_y$, (x>0, y>0)), hafnium silicate ($HfSi_xO_y$, (x>0, y>0)) to which nitrogen is added, hafnium aluminate ($HfAl_xO_y$, (x>0, y>0)) to which nitrogen is added, or the like by a plasma CVD method, a sputtering method, or the like.

An inorganic material containing oxygen is used for the above insulating films, whereby a structure can be provided in which oxygen is supplied from the above insulating films to the oxide semiconductor film and oxygen defects serving as donors are reduced to satisfy the stoichiometric composition even when the oxygen defects are generated in the oxide semiconductor film by heat treatment performed to reduce moisture or hydrogen. Thus, the channel formation region can be made to be close to i-type and a variation in electrical characteristics of the transistor 550 due to oxygen defects can be reduced; accordingly, the electrical characteristics can be improved.

The insulating films in contact with the oxide semiconductor film, such as the gate insulating film 506 and the insulating film 512, may be formed using an insulating material containing a Group 13 element and oxygen. Many of oxide semiconductor materials contain a Group 13 element, and an insulating material containing a Group 13 element works well with oxide semiconductors. By using an insulating material containing a Group 13 element for an insulating film in contact with the oxide semiconductor, an interface with the oxide semiconductor can keep a favorable state.

An insulating material containing a Group 13 element refers to an insulating material containing one or more Group 13 elements. As the insulating material containing a Group 13 element, gallium oxide, aluminum oxide, aluminum gallium oxide, gallium aluminum oxide, or the like can be given as an example. Here, aluminum gallium oxide refers to a material in which the amount of aluminum is larger than that of gallium in atomic percent, and gallium aluminum oxide refers to a material in which the amount of gallium is larger than or equal to that of aluminum in atomic percent.

For example, in the case of forming an insulating film in contact with an oxide semiconductor film containing gallium, a material containing gallium oxide may be used for an insulating film, so that favorable characteristics can be kept at the interface between the oxide semiconductor film and the insulating film. When the oxide semiconductor film and the insulating film containing gallium oxide are provided in contact with each other, pile-up of hydrogen at the interface between the oxide semiconductor film and the insulating film can be suppressed, for example. Note that a similar effect can be obtained in the case where an element belonging to the same group as a constituent element of the oxide semiconductor is used for an insulating film. For example, it is effective to form an insulating film with the use of a material containing aluminum oxide. Note that aluminum oxide has a property of not easily transmitting water. Thus, it is preferable to use a material containing aluminum oxide in terms of preventing entry of water into the oxide semiconductor film.

This embodiment can be implemented in appropriate combination with any of the other embodiments.

Embodiment 4

Figure 13A:
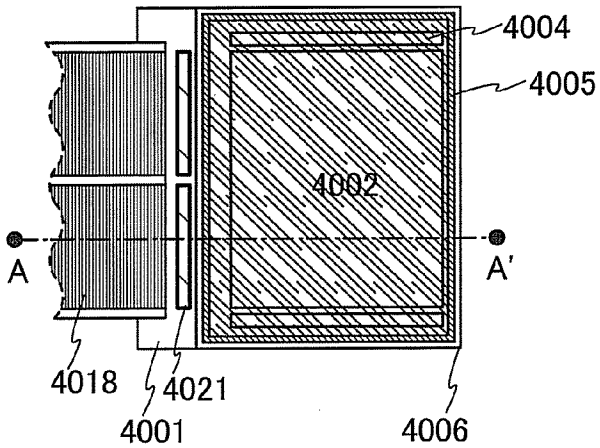
FIGS. 13A and 13B are a top view and a cross-sectional view of a panel, respectively.
Figure 13B:
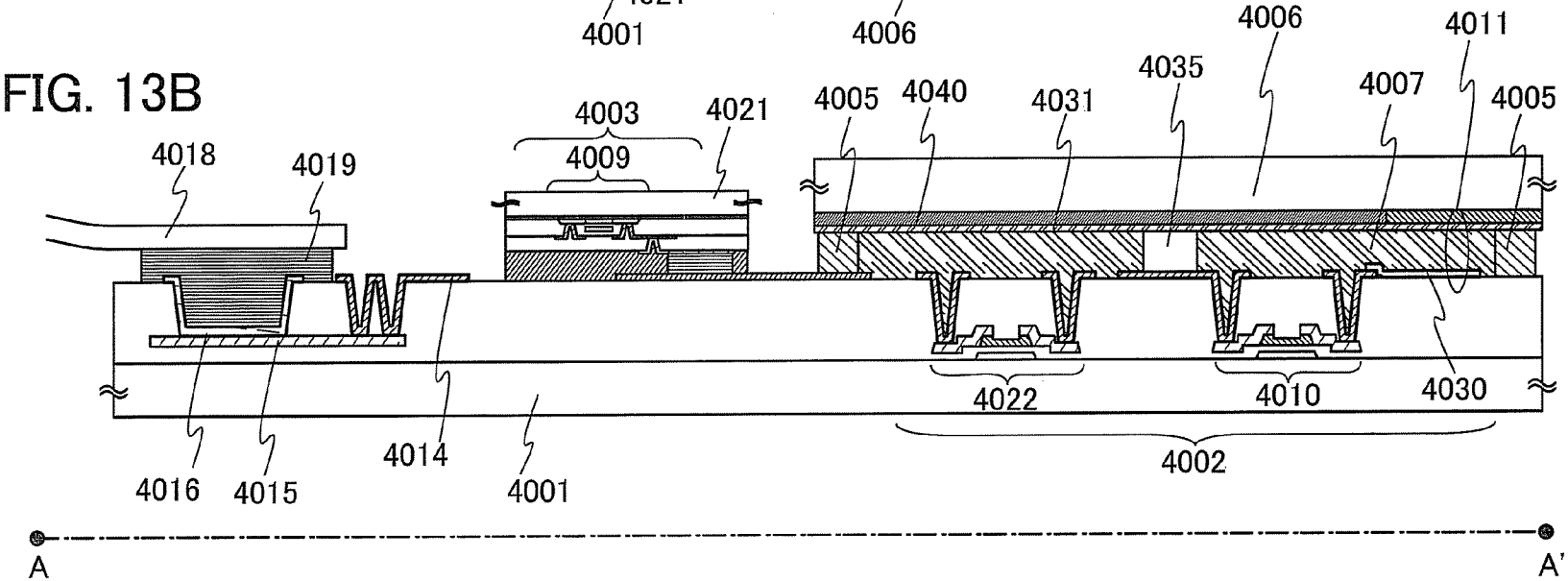

Next, the appearance of a panel in a liquid crystal display device will be described with reference to FIGS. 13A and 13B. FIG. 13A is a top view of the panel in which a substrate 4001 and a counter substrate 4006 are bonded to each other with a sealant 4005. FIG. 13B is a cross-sectional view taken along dashed line A-A' in FIG. 13A.

The sealant 4005 is provided so as to surround a pixel portion 4002 and a scan line driver circuit 4004 provided over the substrate 4001. The counter substrate 4006 is provided over the pixel portion 4002 and the scan line driver circuit 4004. Thus, the pixel portion 4002 and the scan line driver circuit 4004 are sealed together with liquid crystal 4007 by the substrate 4001, the sealant 4005, and the counter substrate 4006.

In addition, a substrate 4021 where a signal line driver circuit 4003 is formed is mounted on the substrate 4001 in a region other than the region surrounded by the sealant 4005. FIG. 13B illustrates a transistor 4009 included in the signal line driver circuit 4003, as an example.

A plurality of transistors are included in the pixel portion 4002 and the scan line driver circuit 4004 provided over the substrate 4001. FIG. 13B illustrates a transistor 4010 and a transistor 4022 that are included in the pixel portion 4002. A light-blocking film 4040 provided for the counter substrate 4006 overlaps with the transistor 4010 and the transistor 4022.

A pixel electrode 4030 included in a liquid crystal element 4011 is electrically connected to the transistor 4010. A common electrode 4031 of the liquid crystal element 4011 is formed on the counter substrate 4006. The liquid crystal element 4011 corresponds to a region where the pixel electrode 4030, the common electrode 4031, and the liquid crystal 4007 overlap with each other.

A spacer 4035 is provided in order to control the distance between the pixel electrode 4030 and the common electrode 4031 (a cell gap). FIG. 13B shows the case where the spacer 4035 is formed by patterning of an insulating film; alternatively, a spherical spacer may be used.

A variety of signals and power supply potentials that are applied to the signal line driver circuit 4003, the scan line driver circuit 4004, and the pixel portion 4002 are supplied from a connection terminal 4016 through leading wirings 4014 and 4015. The connection terminal 4016 is electrically connected to a terminal of an FPC 4018 through an anisotropic conductive film 4019.

For the substrate 4001, the counter substrate 4006, and the substrate 4021, glass, ceramics, or plastics can be used. Examples of plastics are a fiberglass-reinforced plastic (FRP) plate, a polyvinyl fluoride (PVF) film, a polyester film, and an acrylic resin film. In addition, a sheet with a structure in which an aluminum foil is sandwiched between PVF films can be used.

Note that a substrate placed in a direction in which light is extracted through the liquid crystal element 4011 is formed using a light-transmitting material such as a glass plate, plastics, a polyester film, or an acrylic film.

Figure 14:
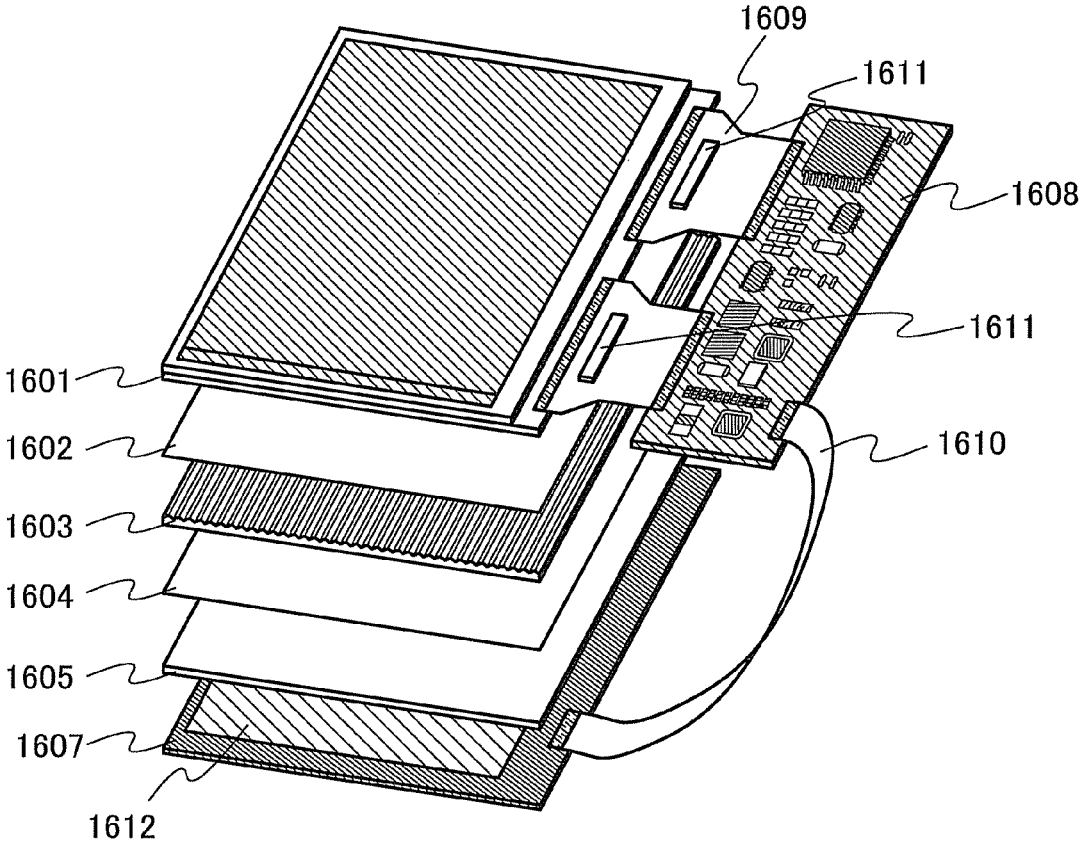
FIG. 14 is a perspective view illustrating a structure of a liquid crystal display device.

FIG. 14 is an example of a perspective view illustrating a structure of a liquid crystal display device. The liquid crystal display device in FIG. 14 includes a panel 1601 including a pixel portion, a first diffuser plate 1602, a prism sheet 1603, a second diffuser plate 1604, a light guide plate 1605, a backlight panel 1607, a circuit board 1608, and a substrate 1611 provided with a signal line driver circuit.

The panel 1601, the first diffuser plate 1602, the prism sheet 1603, the second diffuser plate 1604, the light guide plate 1605, and the backlight panel 1607 are sequentially stacked. The backlight panel 1607 has a backlight 1612 including a plurality of light sources. Light from the backlight 1612 that is diffused in the light guide plate 1605 is delivered to the panel 1601 through the first diffuser plate 1602, the prism sheet 1603, and the second diffuser plate 1604.

Although the first diffuser plate 1602 and the second diffuser plate 1604 are used in this embodiment, the number of diffuser plates is not limited to two. The number of diffuser plates may be one, or may be three or more. The diffuser plate may be provided between the light guide plate 1605 and the panel 1601. Therefore, the diffuser plate may be provided only on the side closer to the panel 1601 than the prism sheet 1603, or may be provided only on the side closer to the light guide plate 1605 than the prism sheet 1603.

The shape of the prism sheet 1603 is not limited to a sawtooth shape in section illustrated in FIG. 14, and may be a shape with which light from the light guide plate 1605 can be concentrated on the panel 1601 side.

The circuit board 1608 is provided with a circuit which generates various signals input to the panel 1601, a circuit which processes the signals, or the like. In FIG. 14, the circuit board 1608 and the panel 1601 are connected to each other with a COF tape 1609. Moreover, the substrate 1611 provided with the signal line driver circuit is connected to the COF tape 1609 by a chip on film (COF) method.

FIG. 14 illustrates an example in which the circuit board 1608 is provided with a control circuit which controls driving of the backlight 1612 and the control circuit and the backlight panel 1607 are connected to each other with an FPC 1610. Note that the control circuit may be formed over the panel 1601. In that case, the panel 1601 and the backlight panel 1607 are connected to each other with an FPC or the like.

Note that FIG. 14 illustrates an example of a case where the direct-below type backlight 1612 provided directly below the panel 1601 is used as a light supply portion; however, the present invention is not limited to this structure. In one embodiment of the present invention, an edge-light type backlight provided at an end portion of the panel 1601 may be used as a light supply portion. Alternatively, in one embodiment of the present invention, a frontlight may be used as a light supply portion.

Figure 15:
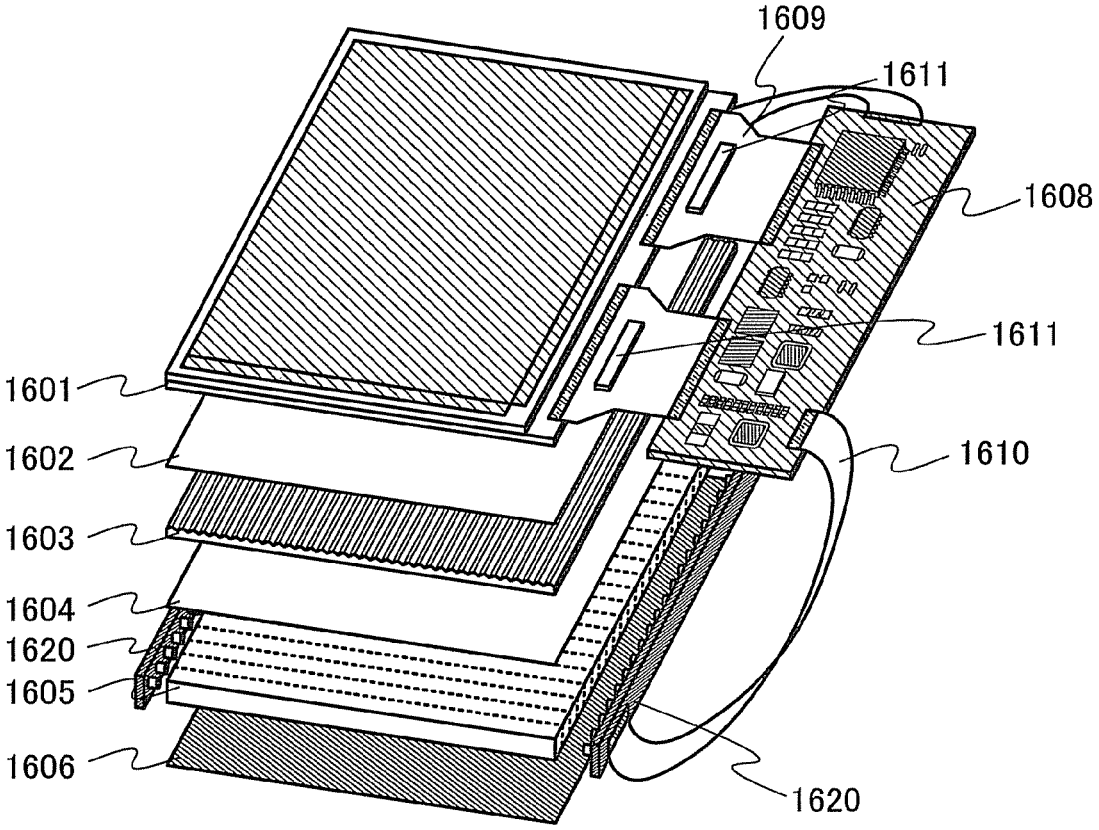
FIG. 15 is a perspective view illustrating a structure of a liquid crystal display device.

FIG. 15 is a perspective view illustrating a structure of a liquid crystal display device in which an edge-light type backlight 1620 is used. In FIG. 15, the backlight 1620 is provided at an end portion of the light guide plate 1605. Light entering the light guide plate 1605 from the backlight 1620 is repeatedly reflected by a surface of the light guide plate 1605 to be transmitted to the panel 1601.

This embodiment can be implemented in appropriate combination with any of the other embodiments.

Example 1

A driving method according to one embodiment of the present invention is employed, whereby a three-dimensional liquid crystal display device which suppresses generation of color breaks or flickers and whose power consumption is low can be provided. Therefore, an electronic device including the above liquid crystal display device has low power consumption and can display a clear three-dimensional image.

Specifically, a driving method according to one embodiment of the present invention is applicable to image display devices, laptops, or image reproducing devices provided with recording media (typically devices which reproduce the content of recording media such as DVDs (digital versatile disc) and have displays for displaying the reproduced images). In addition to the above examples, as electronic devices to which a driving method according to one embodiment of the present invention is applicable, mobile phones, portable game machines, portable information terminals, e-book readers, and the like can be given. Specific examples of these electronic devices are illustrated in FIGS. 16A to 16C.

Figure 16A:
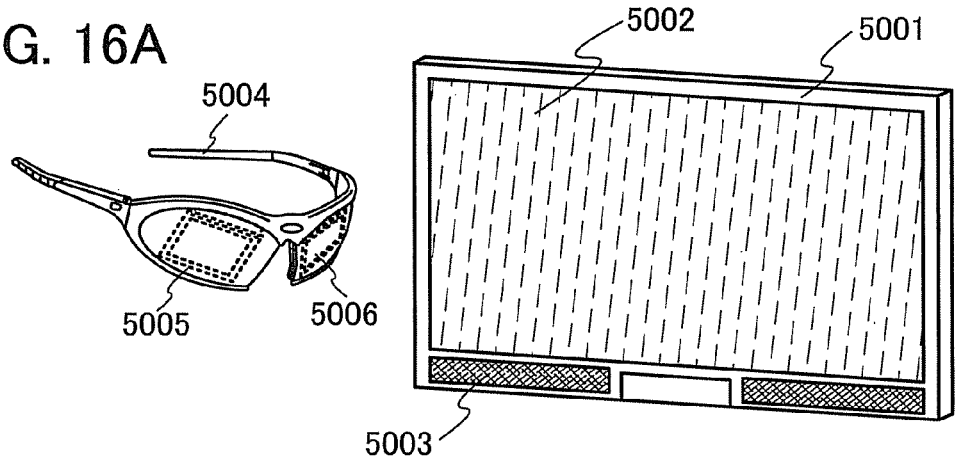
FIGS. 16A to 16C each illustrate an electronic device.

FIG. 16A illustrates an image display device including a housing 5001 for an image display portion, a display portion 5002 corresponding to the image display portion, a speaker portion 5003, glasses 5004 corresponding to a light-blocking portion, and the like. The glasses 5004 include a light control portion 5005 for the right eye and a light control portion 5006 for the left eye. Note that a control portion that controls the transmittance of the light control portion 5005 for the right eye and that of the light control portion 5006 for the left eye in synchronization with display of an image for the right eye or the left eye on the display portion 5002 may be provided for the glasses 5004 or inside the housing 5001 for the image display portion. According to one embodiment of the present invention, an image display device whose power consumption is low and which can display a clear three-dimensional image can be provided.

The display device includes all of information image display devices for personal computers, TV receivers, advertisement displays, and the like.

Figure 16B:
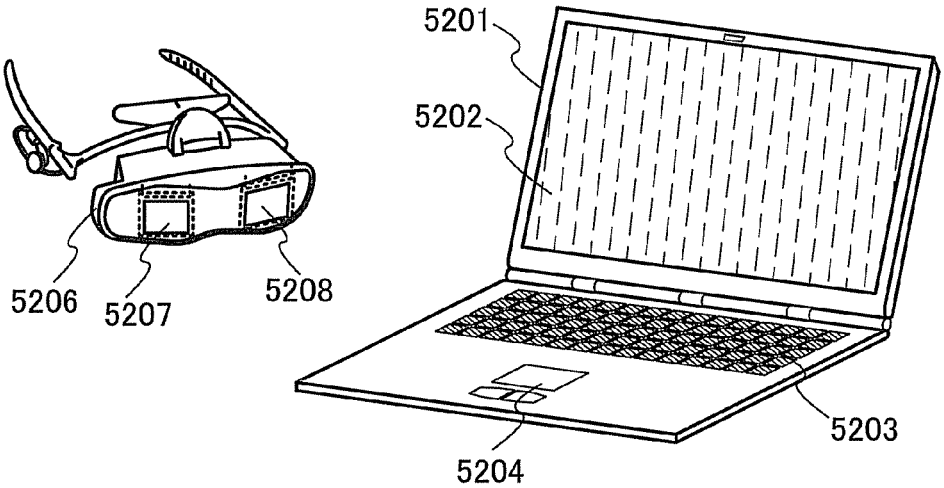
Figure 16C:
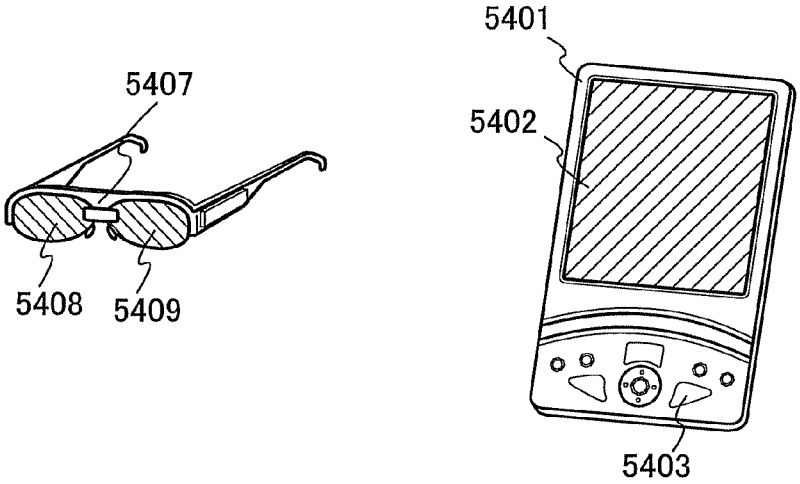

FIG. 16B illustrates a laptop including a housing 5201 for an image display portion, a display portion 5202 corresponding to the image display portion, a keyboard 5203, a pointing device 5204, glasses 5206 corresponding to a light-blocking portion, and the like. The glasses 5206 include a light control portion 5207 for the right eye and a light control portion 5208 for the left eye. Note that a control portion that controls the transmittance of the light control portion 5207 for the right eye and that of the light control portion 5208 for the left eye in synchronization with display of an image for the right eye or the left eye on the display portion 5202 may be provided for the glasses 5206 or inside the housing 5201 for the image display portion. According to one embodiment of the present invention, a laptop whose power consumption is low and which can display a clear three-dimensional image can be provided.

FIG. 16C illustrates a portable information terminal including a housing 5401, a display portion 5402 corresponding to an image display portion, operation keys 5403, glasses 5407 corresponding to a light-blocking portion, and the like. The glasses 5407 include a light control portion 5408 for the right eye and a light control portion 5409 for the left eye. Note that a control portion that controls the transmittance of the light control portion 5408 for the right eye and that of the light control portion 5409 for the left eye in synchronization with display of an image for the right eye or the left eye on the display portion 5402 may be provided for the glasses 5407 or inside the housing 5401. According to one embodiment of the present invention, a portable information terminal whose power consumption is low and which can display a clear three-dimensional image can be provided.

As described above, the application range of the present invention is extremely wide and the present invention can be applied to electronic devices in all fields.

This example can be implemented in appropriate combination with any of the other embodiments.

This application is based on Japanese Patent Application serial no. 2010-266659 filed with Japan Patent Office on Nov. 30, 2010, the entire contents of which are hereby incorporated by reference.

What is claimed is:

1. A driving method of a liquid crystal display device, using one frame period including at least a first field period, a second field period, a third field period, and a fourth field period sequentially provided in this order, comprising the steps of:

inputting a first image signal and a third image signal to a pixel in an odd-numbered row in a pixel portion in the first field period and the third field period, respectively, the first image signal and the third image signal corresponding to a first two dimensional image;

inputting a second image signal and a fourth image signal to a pixel in an even-numbered row in the pixel portion in the second field period and the fourth field period, respectively, the second image signal and the fourth image signal corresponding to a second two dimensional image different from the first two dimensional image;

transmitting light having a first hue to the pixel portion from a light supply portion in the first field period;

transmitting light having a second hue different from the first hue to the pixel portion from the light supply portion in the second field period; and transmitting light having a third hue different from the first hue and the second hue to the pixel portion from the light supply portion in the third field period, wherein the odd-numbered row displays exclusively a line of the first two dimensional image during the first and the third field periods and a single gray scale during the second and the fourth field periods, and wherein the even-numbered row displays exclusively a line of the second two dimensional image during the second and the fourth field periods and the single gray scale during the first and the third field periods.

2. The driving method of a liquid crystal display device, according to claim 1, wherein each pixel comprises:

a transistor; and a liquid crystal element to which the first image signal or the second image signal is applied through the transistor, wherein the transistor includes an oxide semiconductor in an active layer, and wherein a liquid crystal layer in the liquid crystal element includes liquid crystal exhibiting a blue phase.

3. A driving method of a liquid crystal display device, using one frame period including at least a first field period, a second field period, a third field period, and a fourth field period sequentially provided in this order, comprising the steps of:

inputting one of an image signal for a right eye and an image signal for a left eye to a pixel in an odd-numbered row in a pixel portion in the first field period and the third field period, the image signal for the right eye and the image signal for the left eye corresponding respectively to an image for the right eye and an image for the left eye;

inputting the other of the image signal for the right eye and the image signal for the left eye to a pixel in an even-numbered row in the pixel portion in the second field period and the fourth field period;

transmitting light having a first hue to the pixel portion from a light supply portion in the first field period;

transmitting light having a second hue different from the first hue to the pixel portion from the light supply portion in the second field period; and transmitting light having a third hue different from the first hue and the second hue to the pixel portion from the light supply portion in the third field period, wherein the odd-numbered row displays exclusively a line of one of the image for the right eye and the image for the left eye during the first and the third field periods and a single gray scale during the second and the fourth field periods, and wherein the even-numbered row displays exclusively a line of the other one of the image for the right eye and the image for the left eye during the second and the fourth field periods and the single gray scale during the first and the third field periods.

4. The driving method of a liquid crystal display device, according to claim 3, wherein each pixel comprises:

a transistor; and a liquid crystal element to which the image signal for the right eye or the image signal for the left eye is applied through the transistor, wherein the transistor includes an oxide semiconductor in an active layer, and wherein a liquid crystal layer in the liquid crystal element includes liquid crystal exhibiting a blue phase.

5. A driving method of a liquid crystal display device, using one frame period including at least a first field period, a second field period, a third field period, and a fourth field period sequentially provided in this order, comprising the steps of:

displaying a first image by using a pixel in an odd-numbered row in a pixel portion and displaying a single gray scale in a pixel in an even-numbered row in the pixel portion, in the first field period and the third field period;

displaying the single gray scale in the pixel in the odd-numbered row in the pixel portion and displaying a second image by using the pixel in the even-numbered row in the pixel portion, in the second field period and the fourth field period, the second image being different from the first image;

transmitting light having a first hue to the pixel portion from a light supply portion in the first field period;

transmitting light having a second hue different from the first hue to the pixel portion from the light supply portion in the second field period; and transmitting light having a third hue different from the first hue and the second hue to the pixel portion from the light supply portion in the third field period, wherein the odd-numbered row displays exclusively a line of the first image during the first and the third field periods and the single gray scale during the second and the fourth field periods, and wherein the even-numbered row displays exclusively a line of the second image during the second and the fourth field periods and the single gray scale during the first and the third field periods.

6. The driving method of a liquid crystal display device, according to claim 5, wherein each pixel comprises:

a transistor; and a liquid crystal element to which an image signal with data of the first image, the second image, or a blanking signal with data of the single gray scale is applied through the transistor, wherein the transistor includes an oxide semiconductor in an active layer, and wherein a liquid crystal layer in the liquid crystal element includes liquid crystal exhibiting a blue phase.

7. A driving method of a liquid crystal display device, using one frame period including at least a first field period, a second field period, a third field period, and a fourth field period sequentially provided in this order, comprising the steps of:

displaying one of an image for a right eye and an image for a left eye by using a pixel in an odd-numbered row in a pixel portion and displaying a single gray scale in a pixel in an even-numbered row in the pixel portion, in the first field period and the third field period, the image for the right eye being different from the image for the left eye;

displaying the single gray scale in the pixel in the odd-numbered row in the pixel portion and displaying the other of the image for the right eye and the image for the left eye by using the pixel in the even-numbered row in the pixel portion, in the second field period and the fourth field period;

transmitting light having a first hue to the pixel portion from a light supply portion in the first field period;

transmitting light having a second hue different from the first hue to the pixel portion from the light supply portion in the second field period; and transmitting light having a third hue different from the first hue and the second hue to the pixel portion from the light supply portion in the third field period, wherein the odd-numbered row displays exclusively a line of the one of the image for the right eye and the image for the left eye during the first and the third field periods and the single gray scale during the second and the fourth field periods, and wherein the even-numbered row displays exclusively a line of the other one of the image for the right eye and the image for the left eye during the second and the fourth field periods and the single gray scale during the first and the third field periods.

8. The driving method of a liquid crystal display device, according to claim 7, wherein each pixel comprises:

a transistor; and a liquid crystal element to which an image signal with data of the image for the right eye, image data of the image for the left eye, or a blanking signal with data of the single gray scale is applied through the transistor, wherein the transistor includes an oxide semiconductor in an active layer, and wherein a liquid crystal layer in the liquid crystal element includes liquid crystal exhibiting a blue phase.

9. A liquid crystal display device, comprising:

a pixel portion comprising odd-numbered rows of pixels and even-numbered rows of pixels, the liquid crystal display device being configured so that when used:

one frame period includes at least a first field period, a second field period, a third field period, and a fourth field period sequentially provided in this order, an image for one of a right eye and a left eye is displayed in the pixel portion by the odd-numbered rows of pixels during the first field period and the third field period, and an image for the other of the right eye and the left eye is displayed in the pixel portion by the even-numbered rows of pixels in the second field period and in the fourth field period, light having a first hue is transmitted to the pixel portion from a light supply portion in the first field period, light having a second hue different from the first hue is transmitted to the pixel portion from the light supply portion in the second field period, and light having a third hue different from the first hue and from the second hue is transmitted to the pixel portion from the light supply portion in the third field period, wherein a single grayscale period is displayed by the even-numbered rows of pixels during the first field period and the third field period and by the odd-numbered rows of pixels during the second field period and the fourth field period, wherein the image for the right eye is displayed exclusively by one of a first display region constituted only by the odd-numbered rows of pixels and a second display region constituted only by the even-numbered rows of pixels, and wherein the image for the left eye is displayed exclusively by the other one of the first display region and the second display region.

10. A liquid crystal display device, comprising:

a pixel portion comprising odd-numbered rows of pixels and even-numbered rows of pixels, the liquid crystal display device being configured so that when used:

one frame period includes at least a first field period, a second field period, a third field period, and a fourth field period sequentially provided in this order, an image for one of a right eye and a left eye is displayed in the pixel portion by the odd-numbered rows of pixels during the first field period and the third field period, and an image for the other of the right eye and the left eye is displayed in the pixel portion by the even-numbered rows of pixels in the second field period and in the fourth field period, at least light having a first hue and light having a second hue different from the first hue are transmitted to the pixel portion from a light supply portion in the first field period and in the third field period, respectively, at least light having a third hue and light having a fourth hue different from the third hue are transmitted to the pixel portion from the light supply portion in the second field period and in the fourth field period, respectively, and one of the first hue and the second hue is different from one of the third hue and the fourth hue, wherein a single grayscale period is displayed by the even-numbered rows of pixels during the first field period and the third field period and by the odd-numbered rows of pixels during the second field period and the fourth field period, wherein the image for the right eye is displayed exclusively by one of a first display region constituted only by the odd-numbered rows of pixels and a second display region constituted only by the even-numbered rows of pixels, and wherein the image for the left eye is displayed exclusively by the other one of the first display region and the second display region.

11. The liquid crystal display device according to claim 9, further comprising:

a light-blocking portion controlling light transmittance of a first region defined by the odd-numbered rows of pixels and light transmittance of a second region defined by the even-numbered rows of pixels;

wherein the light transmittance of one of the first region and the second region is lowered when the image for the right eye is displayed, and wherein the light transmittance of the other one of the first region and the second region is lowered when the image for the left eye is displayed.

12. The liquid crystal display device according to claim 10, further comprising:

a light-blocking portion controlling light transmittance of a first region defined by the odd-numbered rows of pixels and light transmittance of a second region defined by the even-numbered rows of pixels;

wherein the light transmittance of one of the first region and the second region is lowered when the image for the right eye is displayed, and wherein the light transmittance of the other one of the first region and the second region is lowered when the image for the left eye is displayed.

13. The driving method of a liquid crystal display device according to claim 1, wherein the liquid crystal display device comprises additional odd-numbered rows and additional even-numbered rows, each of the additional odd-numbered rows and the additional even-numbered rows being made of aligned pixels, wherein the aligned pixels of the additional odd-numbered rows all emit the light having the first hue during the first field period in accordance with the first two dimensional image, and wherein the aligned pixels of the additional even-numbered rows all emit the light having the second hue during the second field period in accordance with the second two dimensional image.

14. The driving method of a liquid crystal display device according to claim 3, wherein the liquid crystal display device comprises additional odd-numbered rows and additional even-numbered rows, each of the additional odd-numbered rows and the additional even-numbered rows being made of aligned pixels, wherein the aligned pixels of the additional odd-numbered rows all emit the light having the first hue during the first field period in accordance with the one of the image for the right eye and the image for the left eye, and wherein the aligned pixels of the additional even-numbered rows all emit the light having the second hue during the second field period in accordance with the other of the image for the right eye and the image for the left eye.

15. The driving method of a liquid crystal display device according to claim 5, wherein the liquid crystal display device comprises additional odd-numbered rows and additional even-numbered rows, each of the additional odd-numbered rows and the additional even-numbered rows being made of aligned pixels, wherein the aligned pixels of the additional odd-numbered rows all emit the light having the first hue during the first field period in accordance with the first image, and wherein the aligned pixels of the additional even-numbered rows all emit the light having the second hue during the second field period in accordance with the second image.

16. The driving method of a liquid crystal display device according to claim 7, wherein the liquid crystal display device comprises additional odd-numbered rows and additional even-numbered rows, each of the additional odd-numbered rows and the additional even-numbered rows being made of aligned pixels, wherein the aligned pixels of the additional odd-numbered rows all emit the light having the first hue during the first field period in accordance with the one of the image for the right eye and the image for the left eye, and wherein the aligned pixels of the additional even-numbered rows all emit the light having the second hue during the second field period in accordance with the other of the image for the right eye and the image for the left eye.

* * * * *